US011112202B2

(12) United States Patent
Myers et al.

(10) Patent No.: US 11,112,202 B2
(45) Date of Patent: Sep. 7, 2021

(54) FIREARM SECUREMENT SYSTEM

(71) Applicant: JKAP Industries LLC, Coral Springs, FL (US)

(72) Inventors: Scott D. Myers, Coral Springs, FL (US); Scott Levin, Parkland, FL (US)

(73) Assignee: JKAP INDUSTRIES, LLC, Coral Springs, FL (US)

( * ) Notice: Subject to any disclaimer, the term of this patent is extended or adjusted under 35 U.S.C. 154(b) by 0 days.

(21) Appl. No.: 16/434,877

(22) Filed: Jun. 7, 2019

(65) Prior Publication Data

US 2019/0376757 A1 Dec. 12, 2019

Related U.S. Application Data

(60) Provisional application No. 62/681,919, filed on Jun. 7, 2018, provisional application No. 62/700,962, filed on Jul. 20, 2018.

(51) Int. Cl.
*F41A 23/00* (2006.01)
*F41A 17/02* (2006.01)
*F41A 17/44* (2006.01)

(52) U.S. Cl.
CPC ..... *F41A 23/005* (2013.01); *F41A 17/44* (2013.01)

(58) Field of Classification Search
CPC ..... F41A 17/00; F41A 17/02; F41A 17/04; F41A 17/54; F41A 23/005; F41A 23/00; F41A 23/18; B60R 7/14
See application file for complete search history.

(56) References Cited

U.S. PATENT DOCUMENTS 3,031,787 A * 5/1962 Womble, Jr. ..... F41A 17/02 42/70.01
3,137,957 A * 6/1964 Ingalls ..... F41A 17/44 42/70.11
3,419,728 A * 12/1968 Wilson ..... B60R 7/14 307/9.1
3,624,945 A * 12/1971 Foote ..... F41A 17/02 42/70.11
4,050,662 A * 9/1977 Pickering ..... A47B 81/005 248/309.2
4,076,158 A * 2/1978 Barr ..... B62D 43/08 224/403

(Continued)

*Primary Examiner* — Derrick R Morgan
(74) *Attorney, Agent, or Firm* — Akerman LLP; Michael K. Dixon

(57) ABSTRACT

A portable firearm securement system configured to secure a firearm and prevent firing of the firearm while also being configured to be easily moveable is disclosed. The portable firearm securement system may be formed from first and second bodies for securing a firearm and preventing access to a trigger of the firearm, whereby the first and second bodies are positioned on both sides of the firearm adjacent the trigger and magazine well. Three pins extending from the first body to the second body prevent rotation of a firearm relative to the first and second bodies. Additionally, one pin extends thru the second body and includes a securement orifice through which a padlock shackle may be positioned to lock a firearm in place within the securement system. The securement system may be releasably secured to a securement object with a tether wrapped around the securement object and secured to the padlock.

20 Claims, 24 Drawing Sheets

(56) References Cited

U.S. PATENT DOCUMENTS 4,139,100 A * 2/1979 Reed ..... F41A 17/02 211/4
4,198,026 A * 4/1980 Capolupo ..... F41A 17/02 211/4
4,299,045 A * 11/1981 Cervantes ..... F41A 17/74 42/70.07
4,624,372 A * 11/1986 Brolin ..... A47B 81/005 211/4
5,012,605 A * 5/1991 Nishioka ..... F41A 17/54 42/70.07
5,016,377 A * 5/1991 Gunning ..... F41A 17/44 42/70.11
5,048,212 A * 9/1991 Mossberg ..... F41A 17/02 42/70.06
5,129,563 A * 7/1992 Dillon ..... B60R 7/14 224/275
5,261,177 A * 11/1993 Armstrong ..... F41A 17/74 42/70.08
5,351,507 A * 10/1994 Derman ..... E05B 73/0005 248/553
5,392,551 A * 2/1995 Simpson ..... F41A 17/54 42/70.07
5,400,538 A * 3/1995 Shannon ..... F41A 17/04 42/70.06
5,412,959 A * 5/1995 Bentley ..... E05B 67/003 42/66
5,437,119 A * 8/1995 Womack ..... F41A 17/54 42/70.07
5,450,684 A * 9/1995 Harris ..... F41A 17/54 42/70.07
5,515,633 A * 5/1996 Harris ..... F41A 17/54 42/70.07
5,551,181 A * 9/1996 Upton ..... F41A 17/54 42/70.07
5,579,923 A * 12/1996 Hemmerlein ..... A47B 81/005 211/4
5,680,723 A * 10/1997 Ruiz ..... F41A 17/44 42/70.07
5,887,730 A * 3/1999 St. George ..... A47B 81/005 211/4
5,918,402 A * 7/1999 Weinraub ..... F41A 17/54 42/70.07
5,927,578 A * 7/1999 Kay ..... F41A 17/02 224/244
5,960,575 A * 10/1999 Chiovitt ..... F41A 17/54 42/70.07
6,082,601 A * 7/2000 Standish ..... B60R 7/14 206/317
6,142,313 A * 11/2000 Young ..... F41A 17/02 211/4
6,272,784 B1 * 8/2001 Ringers ..... F41A 17/54 42/70.07
6,330,815 B1 * 12/2001 Duncan ..... B60R 7/14 211/4
6,393,877 B1 * 5/2002 Church ..... A47F 5/0846 211/59.1
6,457,272 B1 * 10/2002 Weinraub ..... F41A 17/54 42/70.07
6,467,211 B1 * 10/2002 Kielland ..... F41A 17/54 42/70.06
6,474,238 B1 * 11/2002 Weinraub ..... F41A 17/54 42/70.07
6,487,803 B1 * 12/2002 Yu ..... F41A 17/54 42/70.07
6,519,983 B2 * 2/2003 Witchey ..... B60R 25/008 70/14
6,612,140 B1 * 9/2003 Strassell ..... F41A 17/02 211/4
6,684,548 B1 * 2/2004 Petrus ..... E05B 73/00 211/4
7,367,150 B2 * 5/2008 Farchione ..... F41A 17/54 42/70.07
7,730,750 B2 * 6/2010 Victor ..... E05B 73/00 211/64
8,186,087 B2 * 5/2012 Ogershok ..... F41A 17/54 42/70.06
8,347,539 B2 * 1/2013 Burns, III ..... F41A 17/54 42/70.06
8,347,664 B2 * 1/2013 Bishir, Jr. ..... E05B 37/025 124/86
8,540,086 B2 * 9/2013 Karst ..... A47B 81/005 211/4
10,001,334 B1 * 6/2018 Farchione, Jr. ..... F41A 17/54
10,139,184 B1 * 11/2018 Pintar ..... A47B 81/005
10,161,713 B1 * 12/2018 Goldense ..... F41A 11/04
10,228,206 B2 * 3/2019 Bordley ..... F41A 17/54
10,488,133 B1 * 11/2019 Karczwski ..... F41A 17/54
10,578,390 B2 * 3/2020 Pintar ..... A47B 81/005
2002/0069569 A1 * 6/2002 Riebling ..... F41A 17/54 42/70.07
2003/0102273 A1 * 6/2003 McMurray ..... A47F 5/0861 211/5
2004/0148840 A1 * 8/2004 Jean Levilly ..... F41A 23/16 42/94
2005/0145585 A1 * 7/2005 Pintar ..... A47F 7/0028 211/64
2006/0112605 A1 * 6/2006 Sopko ..... F41A 17/54 42/70.11
2006/0288625 A1 * 12/2006 Williams ..... F41A 17/54 42/70.11
2010/0107465 A1 * 5/2010 Pintar ..... F41A 17/02 42/70.07
2010/0269551 A1 * 10/2010 Bishir, Jr. ..... F41B 5/14 70/57
2012/0005935 A1 * 1/2012 Chandler ..... F41A 17/02 42/70.11
2013/0061502 A1 * 3/2013 Derman ..... F41A 17/54 42/70.07
2015/0033609 A1 * 2/2015 Herdman ..... F41A 23/18 42/70.07
2015/0033810 A1 * 2/2015 Zalavari ..... A47B 81/00 70/266
2015/0128668 A1 * 5/2015 Meredith ..... G07C 9/00563 70/266
2015/0260480 A1 * 9/2015 Dunn ..... F41C 33/06 42/70.11
2016/0054083 A1 * 2/2016 Kiyani ..... F41A 17/06 42/70.11
2016/0377362 A1 * 12/2016 Farr ..... F41A 17/04 42/70.06
2017/0122010 A1 * 5/2017 McCanna ..... F41C 33/06
2017/0191775 A1 * 7/2017 Bibee ..... F41A 17/54
2018/0202738 A1 * 7/2018 Post ..... F41A 17/04
2018/0238650 A1 * 8/2018 Stockton ..... F41A 17/44
2018/0372446 A1 * 12/2018 Mack ..... E05B 73/0005
2019/0212086 A1 * 7/2019 Shiner ..... F41A 17/06
2019/0376757 A1 * 12/2019 Myers ..... F41A 17/44

* cited by examiner

FIREARM SECUREMENT SYSTEM

CROSS-REFERENCE TO RELATED APPLICATION

This application claims the benefit of United States Provisional Patent Application No. 62/681,919, Filed Jun. 7, 2018, and claims the benefit of U.S. Provisional Patent Application No. 62/700,962, filed Jul. 20, 2018, the entirety of which is incorporated herein.

FIELD OF THE INVENTION

This invention is directed generally to firearms, and more particularly to systems configured to secure firearms.

BACKGROUND

Law enforcement typically secure their long firearms in their vehicles when the firearms are not in use to prevent theft, accidents, etc. Conventional gun safety systems have often been complex systems that are permanently mounted in a vehicle and typically in a vehicle's trunk. Accessing long firearms in a trunk from a complex system when an officer is called to a scene demanding immediately action results in unnecessary delay and potential unnecessary loss of life and escalation of the situation. In addition, law enforcement personnel often use multiple vehicles in an assignment, often complicating matters for law enforcement personnel to be certain the proper long firearm restraint devices are present. Additionally, law enforcement departments are often leasing vehicles for differing periods of time, thereby making permanently attached firearm restraint devices problematic because such devices increase the workload on vehicle maintenance personnel to detach the equipment from one vehicle and move it to another vehicle. Thus, a need exists for a most robust, system that provides quicker access to law enforcement personnel.

SUMMARY OF THE INVENTION

A portable firearm securement system configured to secure a firearm and prevent firing of the firearm while also having a capability of being easily moveable (portable) is disclosed. The portable firearm securement system is formed from first and second bodies, such as a base plate and a top plate, for securing a firearm, preventing access to a trigger of the firearm and preventing manipulation of the firearm, whereby the top plate and base plate may be positioned on both sides of the firearm adjacent the trigger and magazine well. Three pins extending from the base plate to the top plate prevent rotation of a firearm relative to the plates. Additionally, at least one pin extends thru the top plate and includes a securement orifice through which a shackle of a padlock may be positioned to lock a firearm in place within the securement system. In at least one embodiment, the pins extend through the top plate. The securement system may be releasably secured to a securement object, such as, but not limited to, a vehicle, with a cable wrapped around at least part of the securement object and with at least one end of the cable secured to a shackle of the padlock. The portable firearm securement system may be easily moved between vehicles or other locations by simply removing the cable from the padlock.

An advantage of the portable firearm securement system is that the portable firearm securement system renders a firearm completely inoperable. A firearm secured by the portable firearm securement system cannot be disassembled or have the magazine removed from the firearm. The safety lever, trigger, magazine release, and take down pins are completely shielded by the device rendering them inaccessible when the firearm is secured within the portable firearm securement system. The portable firearm securement system can be easily moved from one vehicle to another (or any other structure) by removing the cable/chain from the padlock. The portable firearm securement system can also be used in a structure or vehicle by permanently mounting/affixing the device via use of mounting bolts extending through holes in the base plate. This mounting option enables the portable firearm securement system to either be used in a portable manner or in a permanent configuration.

When used properly, a first pin, which may be, but is not limited to being, a position restriction pin or a CW1 pin, prevents a second pin, which may be, but is not limited to being, a locking pin, from being able to contact or manipulate the trigger. The first pin also prevents rotation of the firearm in a counter-clockwise direction when installed in the securement system. The third pin prevents rotation of the firearm in a clockwise direction when installed in the securement system. The securement system is configured to reduce the likelihood of damage to the firearm with protective foam positioned on interior surfaces of the top and base plates and using a protective coating, such as, but not limited to, a protective chemical coating on the outside of the plates and on the pins.

Another advantage of the portable firearm securement system is that the portable firearm securement system can be used in a non-mounted, portable fashion such that the system may easily be moved from one vehicle to another. Having the ability to secure a weapon via a cable/chain allows the system to be used in many roles (vehicles, boats, structures, etc). The system is rugged and has no moving parts, thus reducing the likelihood of requiring maintenance.

Still another advantage of the portable firearm securement system is that bottom shield prevents a firearm secured within the system from being accessed while in the system and prevents one from accessing the trigger of the firearm.

Another advantage of the portable firearm securement system is that the system prevents access to the breach of the firearm thereby preventing the firearm from being loaded or unloaded when the firearm is secured within the system between the first and second bodies.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 27:
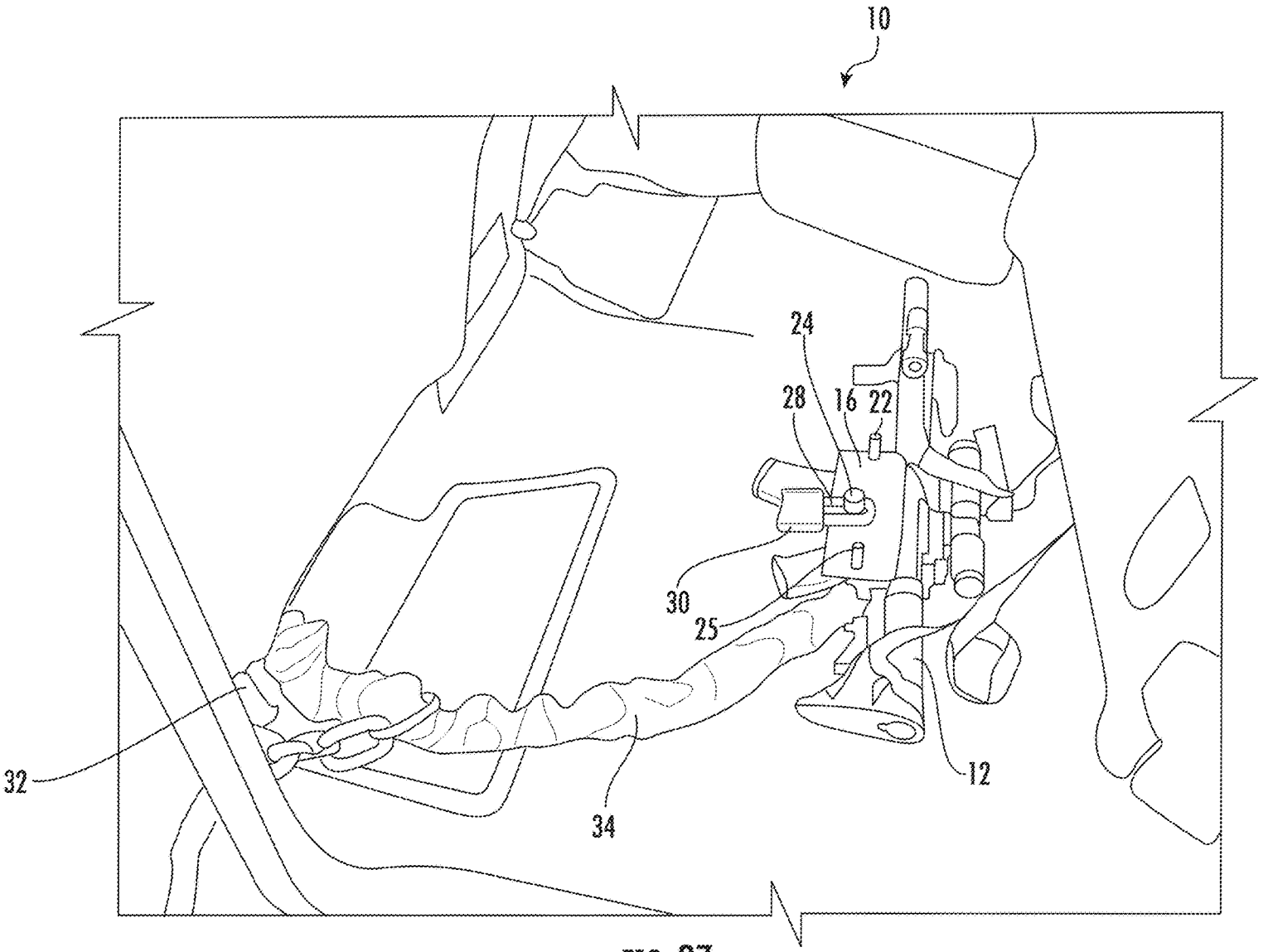
FIG. 27 is a perspective view of a firearm secured within the portable firearm securement system and resting on a floor of a vehicle while the system with the firearm is secured to a seat support structure of the vehicle.
Figure 28:
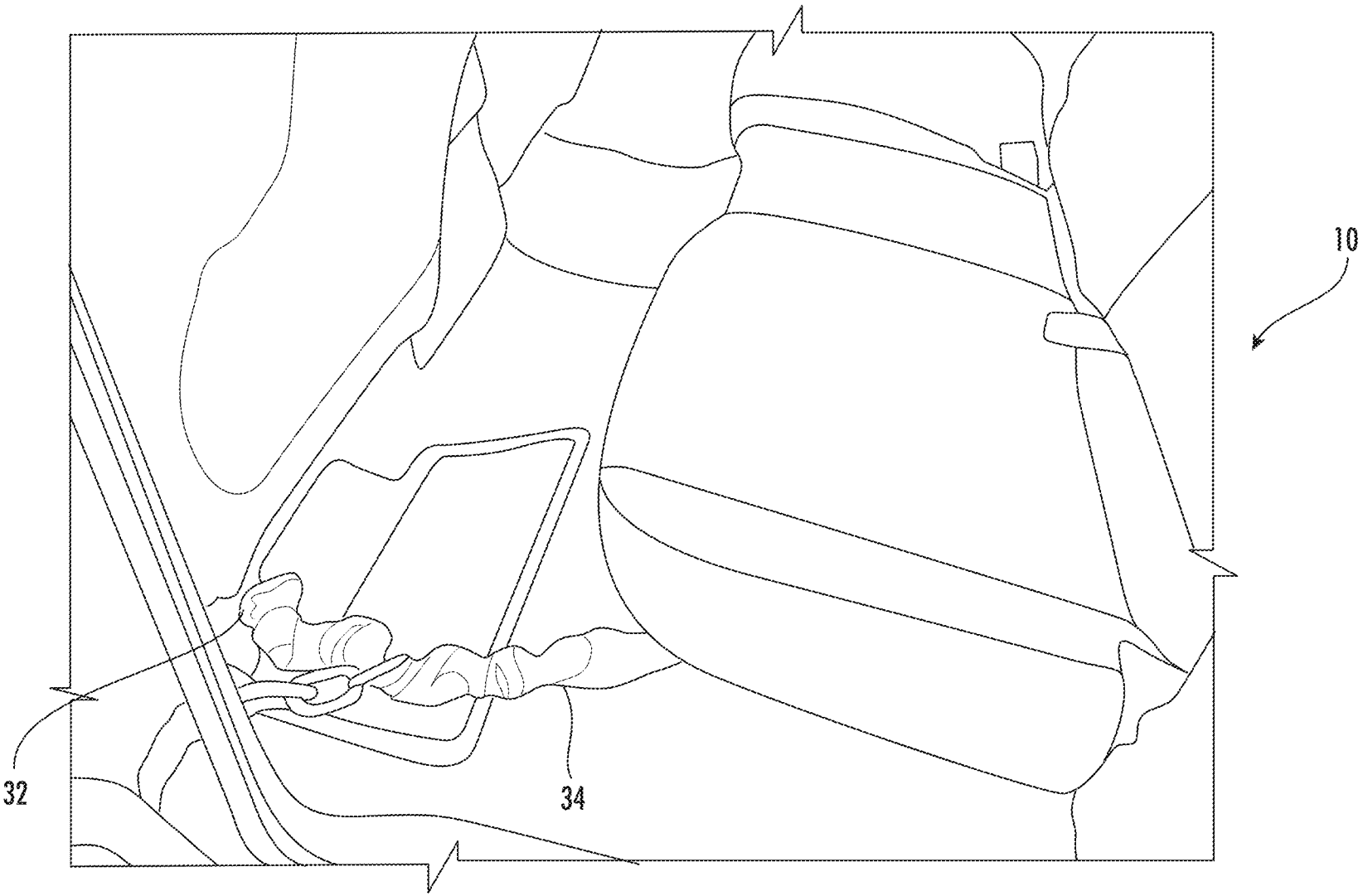
FIG. 28 is a perspective view of the same portion of a vehicle shown in FIG. 27 with the seat folded down thereby concealing the system and the firearm secured within the system.

As shown in FIGS. 1-28, a portable firearm securement system 10 configured to secure a firearm 12 and prevent firing of the firearm 12 while also having a capability of being portable is disclosed. The portable firearm securement system 10 may be formed from first and second bodies 14, 16 for securing a firearm 12 and preventing access to a trigger 18 of the firearm 12, whereby the first and second bodies 14, 16 may be positioned on both sides of the firearm 12 adjacent the trigger 18 and magazine well 20. Three pins 22, 24, 25 extending from the first body 14 to the second body 16 prevent rotation of a firearm 12 relative to the first and second bodies 14, 16. Additionally, one pin 24 extends thru the second body 16 and includes a securement orifice 26 through which a shackle 28 of a padlock 30 may be positioned to lock a firearm 12 in place within the securement system 10. The securement system 10 may be releasably secured to a securement object 32, such as, but not limited to, a vehicle, as shown in FIGS. 27 and 28, with a cable 34 wrapped around at least part of the securement object 32 and with at least one end 36 of the cable 34 secured to a shackle 28 of the padlock 30. The portable firearm securement system 10 may be easily moved between vehicles or other locations by simply removing the cable 34 from the shackle 28 of the padlock 30.

The portable firearm securement system 10 may be configured to secure a firearm in place and prevent access to the breach and trigger of the firearm. In at least one embodiment, the portable firearm securement system 10 may be configured to secure a long gun, such as, but not limited to, a shotgun or rifle. In at least one embodiment, the portable firearm securement system 10 may be configured to secure an AR-15 rifle. In other embodiments configured to secure other guns, the placement of the pins 22, 24, 25 and first and second bodies 14, 16 may need to be moved relative to each other to prevent user access to the magazine, trigger and bolt of the gun while secured within the system 10 and to prevent the firearm from being disassembled while secured within the system 10.

In at least one embodiment, the portable firearm securement system 10 may be formed from a first body 14 for securing a firearm 12 and preventing access to a trigger 18 of the firearm 12. The portable firearm securement system 10 may also include a second body 16 securing a firearm 12 and preventing access to a trigger 18 of the firearm 12, whereby the first and second bodies 14, 16 form a firearm securement cavity 46 between the first and second bodies 14, 16. In at least one embodiment, the first body 14 may be formed from, but is not limited to being, a plate. In other embodiments, the first body 14 may be configured other than as a plate. The first body 14 may include a first pad 48 attached to an inner side 50 of the first body 14 for protecting a firearm 12 secured within the system 10 and to create a retention force exerted by the first body 14 on the firearm 12. Similarly, the second body 16 may be formed from, but is not limited to being, a plate. In other embodiments, the second body 16 may be configured other than as a plate. The second body 16 may include a second pad 52 attached to an inner side 54 of the second body 16 for protecting a firearm 12 secured within the system 10 and to create a retention force exerted by the second body 16 on the firearm 12. The first and second bodies 14, 16 may be formed from, but are not limited to, metal, such as steel and aluminum, plastics and the like. The first and second pads 48, 52 may be formed from any flexible material unlikely to scuff or otherwise damage a firearm.

A first pin 22 may be secured to the first body 14 and may extend toward the second body 16. A second pin 24 may be secured to the first body 14 and may extend thru an orifice 38 in the second body 16. A third pin 25 may be secured to the first body 14 and may extend toward the second body 16. The pins 22, 24, 25 may be formed as a unitary structure with the first body 14 or may be attached to the first body 14, such as, but not limited to welding, a threaded connection and the like. The pins 22, 24, 25 may extend from the first body 14 generally parallel to each other. In at least one embodiment, the pins 22, 24, 25 may extend generally orthogonal from the first body 14. In at least one embodiment, the second pin 24 may be larger than the first and third pins 22, 25 and may be sized to fit within a trigger guard 40 without permitting the second pin 24 to contact the trigger. The second pin 24 may be sized to be approximately the same size as the distance between the trigger guard 40 and the firearm body 12. In at least one embodiment, the pins 22, 24, 25 may be, but are not required to be, cylindrical. The pins 22, 24, 25 may be formed from, but are not limited to, metal, such as steel and aluminum, plastics and the like. In another embodiment, as shown in FIGS. 14-26, the first and third pins 22, 25 may extend through first and second orifices 39 and 41 to prevent movement of the second body 16 relative to the first body 14.

The first, second and third pins 22, 24, 25 may be positioned on the first body 14 relative to each other to restrict movement of the firearm 12 secured therein, and to specifically, prevent the firearm 12 from being rotated to then grant a user access to pins, screws and the like within the firearm 12 to disassemble the firearm 12 to get around the system 10. A distance between the first pin 22 and second pin 24 may be greater than a length of a magazine well 20 on a firearm 12 but less than a distance of the length of a magazine well 20 on the firearm plus a distance between the magazine well 20 and a trigger 18 of the firearm 12 minus a diameter of the second pin 24. In at least one embodiment, a distance between the first pin 22 and second pin 24 is greater than a length of a magazine well 20 on a firearm 12 plus no more than 0.25". In another embodiment, a distance between the first pin 22 and second pin 24 is greater than a length of a magazine well 20 on a firearm plus no more than 0.05".

The third pin 25 may be positioned to prevent a firearm 12 from rotating relative to the first body 14. The third pin 25 may be positioned on the first body 14 to correspond with being positioned in close proximity to a proximal surface of the firearm and, in at least one embodiment, at a base of the handle 60 where the handle 60 attaches to the firearm 12. In at least one embodiment, there should be no more than 0.25 inch between the third pin 25 and the firearm 12 when the firearm 12 is positioned on the first body 14. In another embodiment, there should be no more than 0.05 inch between the third pin 25 and the firearm 12 when the firearm 12 is positioned on the first body 14.

The pins 22, 24, 25 may have the same lengths or may have different lengths. In at least one embodiment, the second pin 24 may be longer than the first pin 22 and the third pin 25. In such an embodiment, the second pin 24 may extend through the orifice 38 in the second body 16. The second pin 24 may include a securement orifice 26 positioned in the second pin 24 in the portion the second pin 24 that extends thru the orifice 38 in the second body 16. The securement orifice 26 in the second pin 24 may be proximate to a distal end 44 of the second pin 24 for securing the second body 16 in place on the second pin 24. The securement orifice 26 may be positioned generally orthogonal to a longitudinal axis 42 of the second pin 24. The securement orifice 26 may be sized to receive a shackle 28 of a padlock 30. In at least one embodiment, the position of the securement orifice 26 may be such that the second body 16 must be compressed against the firearm 12 and the first body 14 so that the shackle 28 can be inserted into the securement orifice 26. In another embodiment, the second pin 24 may be shorter than the first or third pin 22, 25, or both.

The portable firearm securement system 10 may include a locking mechanism, which may be, but is not limited to being, a padlock 30 with a shackle 28 sized to fit within the securement orifice 26 in the second pin 24 to prevent the second body 16 from being removed from the second pin 24. The portable firearm securement system 10 may include a tether 34 with loops 36 at each end for securing the portable firearm securement system 10 to a securable object by looping one end of the tether 34 around at least a portion of the securable object and attaching at least one end of the tether 34 to the shackle 28 of the padlock 30 or to one of the pins 22, 24, 25, as shown in FIGS. 14-26. In at least one embodiment, the tether 34 may be but is not limited to being a chain or a flexible cable. In other embodiments, as shown in FIGS. 14-26, a loop of the tether 34 may be attached to the third pin 25. Attaching the tether 34 to the third pin 25 makes it easier for a user in the heat of the moment when under stress to more quickly remove the padlock 30 from the second pin 24 than embodiments where the tether is attached to the second pin 24.

The portable firearm securement system 10 may also include a bottom shield 60 extending from the first body 14 generally toward the second body 16 and positioned between the second pin 24 and an edge 62 of the first body 14, as shown in FIGS. 14-26. The bottom shield 60 may be near the edge 62 or at the edge 62 of the first body 14. In at least one embodiment, the bottom shield 60, may be, but is not limited to being a plate. The bottom shield 60, may be, but is not limited to being rectangular. The bottom shield 60, may be, but is not limited to being rigid to prevent access inside trigger guard 40 of the firearm 12. The bottom shield 60 prevents firearms from being installed improperly. The bottom shield only allowed firearms to be placed on the first body in a proper manner. The bottom shield also prevents the top and bottom plates from being compressed together. The bottom shield also prevents anyone from getting a finger into the trigger guard while a firearm is secured between the first and second bodies 14 and 16.

The portable firearm securement system 10 may also include a side shield 64, as shown in FIGS. 14-26, extending from the first body 14 generally toward the second body 16 and positioned between the first pin 22 and an edge 62 of the first body 14. The side shield 64 may be positioned near the edge 66 or at the edge 66 of the second body. The side shield 64 may be, but it not limited to being a plate. The side shield 64 may be, but it not limited to being rectangular. The side shield 64 may be, but it not limited to being rigid to prevent access inside trigger guard. The bottom and side shields 60, 64 prevent tampering with a firearm 12 that is secured between the first and second bodies 14, 16 and prevent the firearm 12 from being discharged, loaded, disassembled, broken or otherwise damaged to remove the firearm 12 from the portable firearm securement system 10. The bottom and side shields 60, 64 also prevent the second body 16 from being compressed against a firearm 12 and from being compressed against the first body 14, thereby preventing damage from occurring to the firearm or this device.

In at least one embodiment, the first body 14 may have an alternative configuration. In particular, the first body 14 may have a side shield 64 at a first side 68 and first and second angled corners 70, 72 at a second side 74. The first side 68 may include a third angled corner 76. The first and second angled corners 70, 72 at the second side 74 are configured to accommodate different firearm configurations, such as, collapsing folding stocks and strap accessories. The first angle 70 at the second side 94 may be a complex angle formed from two or more angled portions, such as 78, 80, that may or may not be linear to accommodate different and future firearms 12 and firearms configurations that have yet to be conceived.

The second body 16 may have an alternative configuration. In particular, the second body 16 first and second angled corners 90, 92 at a second side 94. The first side 98 may include a third angled corner 96. The first and second angled corners 90, 92 at the second side 94 are configured to accommodate different firearm configurations, such as, collapsing folding stocks and strap accessories. The first angle 90 at the second side 94 may be a complex angle formed from two or more angled portions, such as 100, 102, that may or may not be linear to accommodate different and future firearms 12 and firearms configurations that have yet to be conceived.

The portable firearm securement system 10 may include one or more mounting holes 58 enabling the portable firearm securement system 10 to be securely mounted to a structure. Connectors, such as, but not limited to screws or bolts, may be used to attach the first body 14 to a structure via the mounting holes 58. Once the first body 14 is attached to the structure, the portable firearm securement system 10 may be used to secure a firearm 12 without need for a cable 34.

Figure 1:
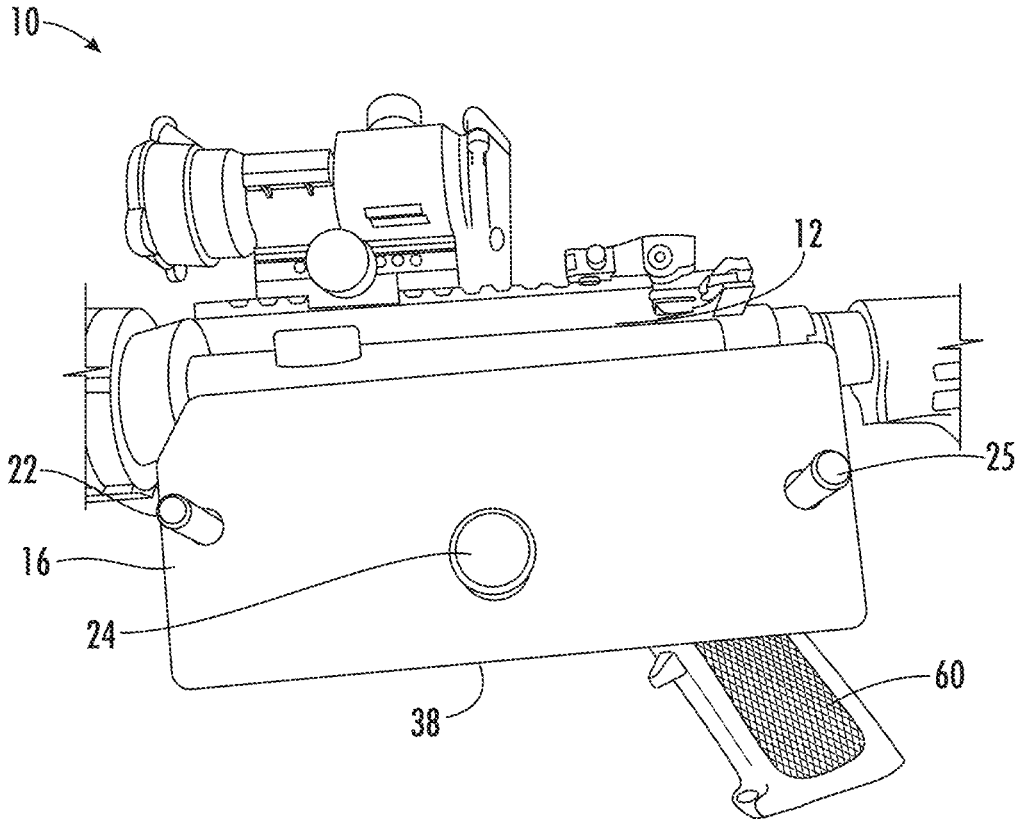
FIG. 1 is a side view of a firearm positioned in the portable firearm securement system.
Figure 2:
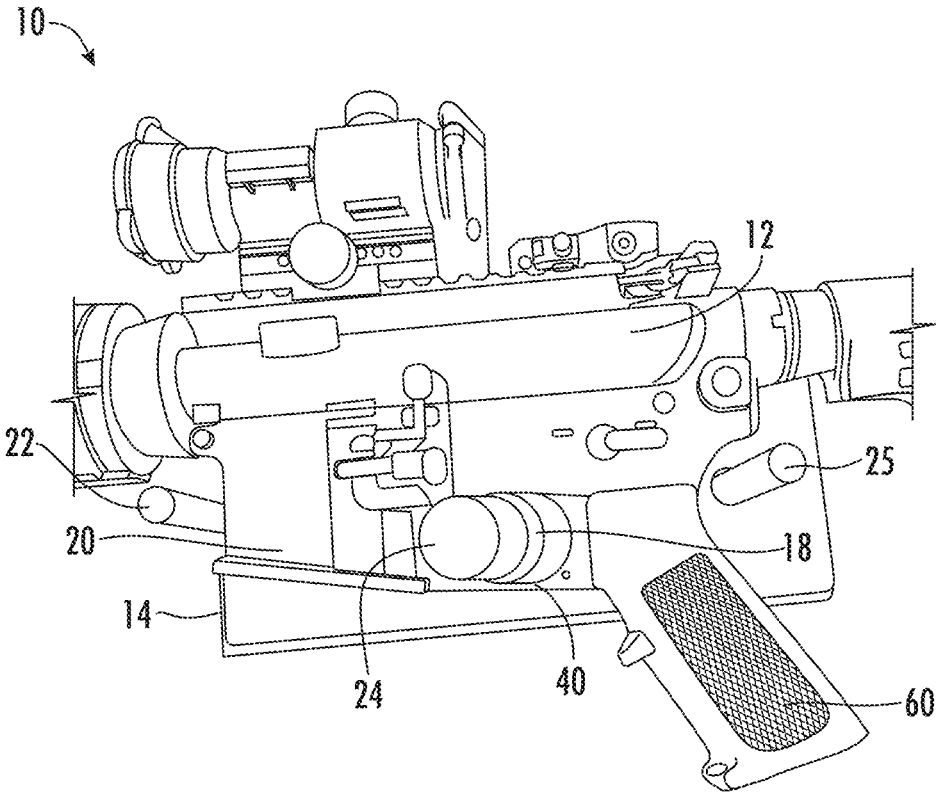
FIG. 2 is a side view of a firearm positioned in the portable firearm securement system with the second body removed.
Figure 3:
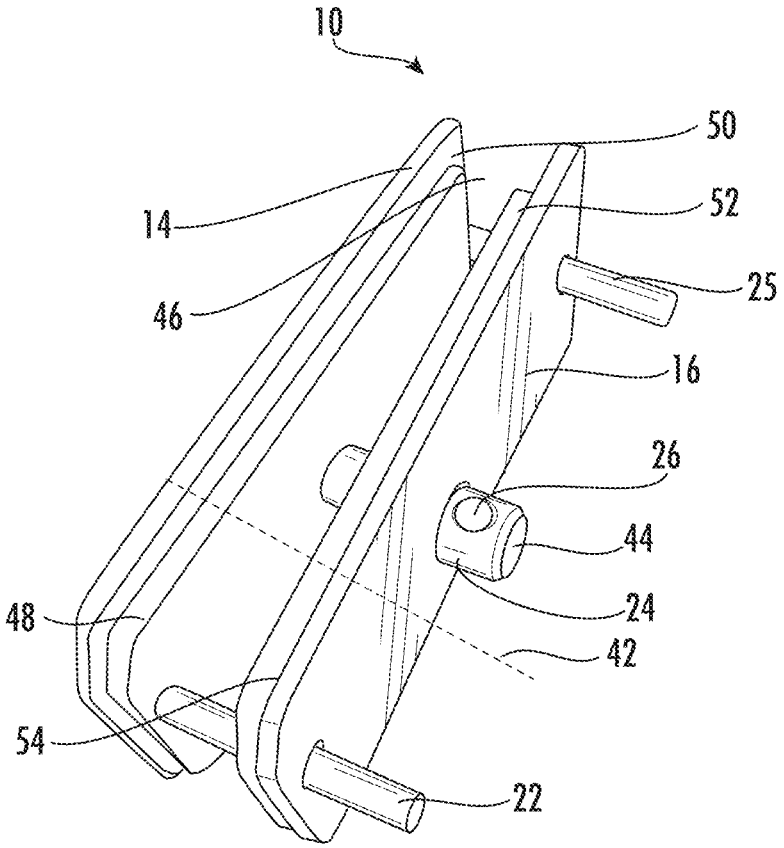
FIG. 3 is a perspective view of the portable firearm securement system.
Figure 4:
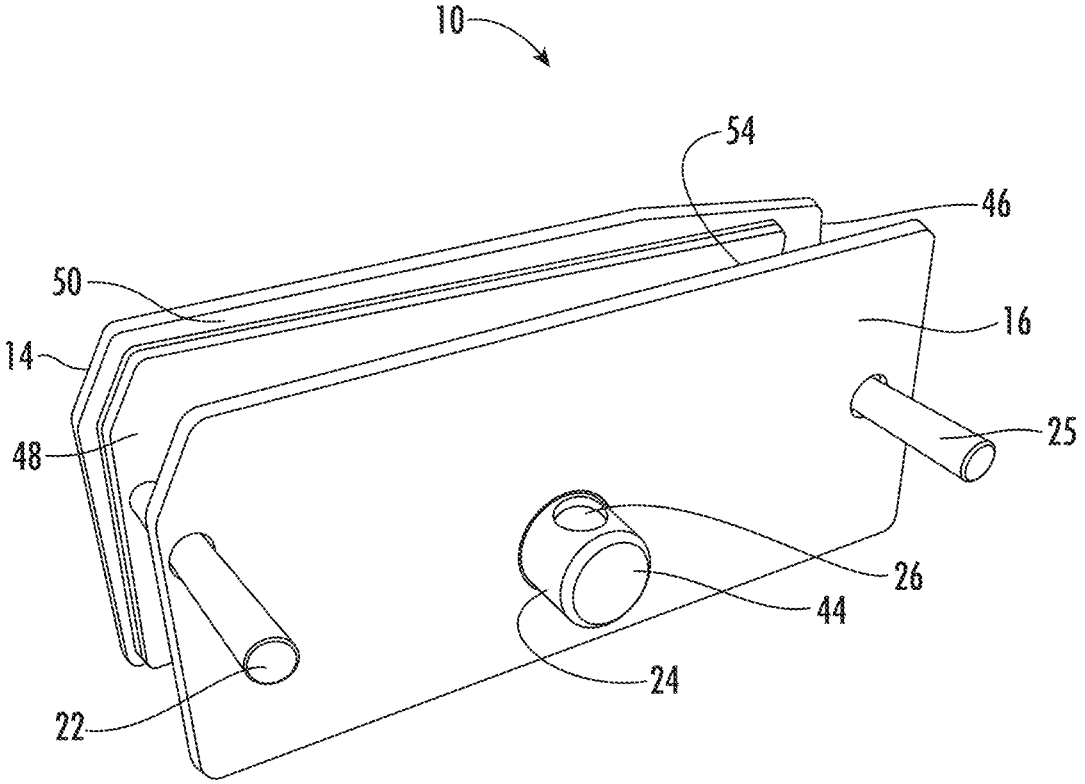
FIG. 4 is another perspective view of the portable firearm securement system.
Figure 5:
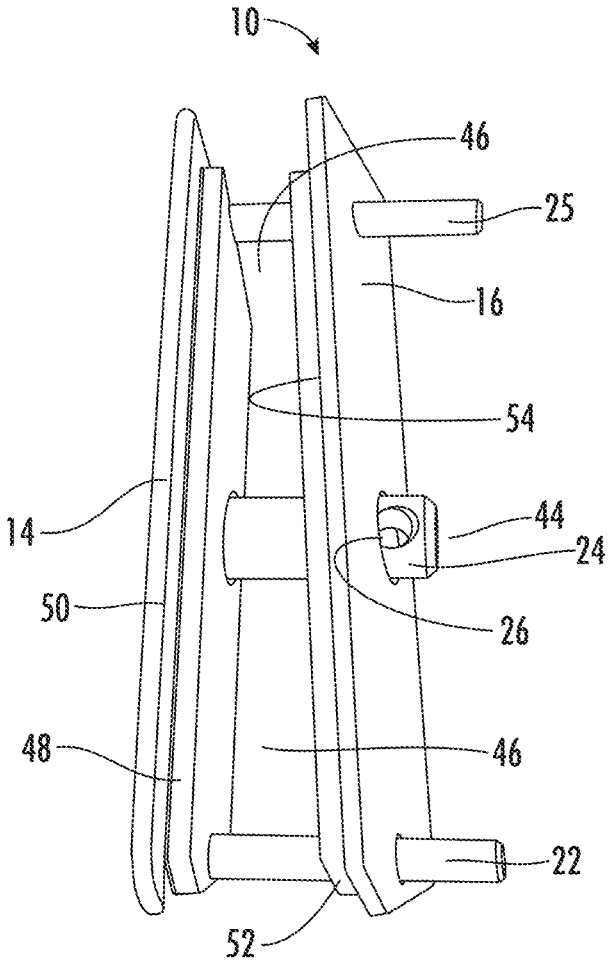
FIG. 5 is a top view of the portable firearm securement system.
Figure 6:
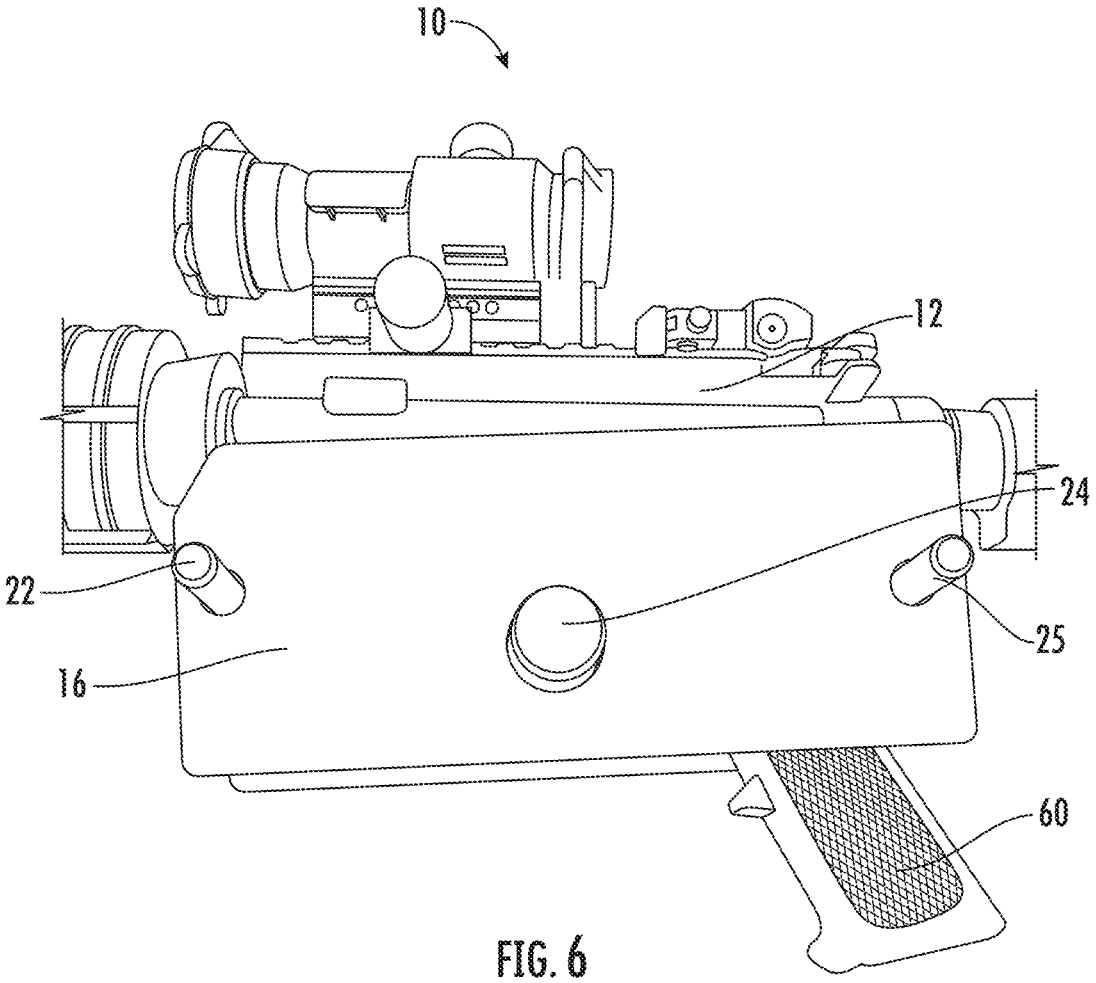
FIG. 6 is a detail view of the second plate of the portable firearm securement system.
Figure 7:
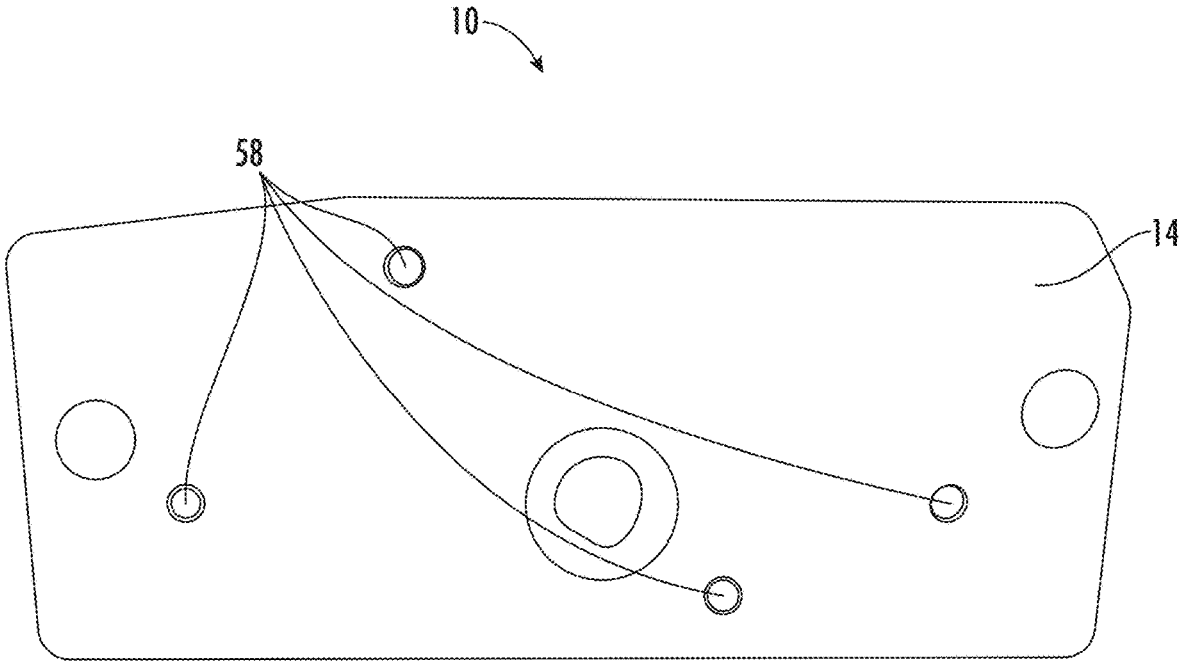
FIG. 7 is a bottom view of the first plate of the portable firearm securement system.
Figure 8:
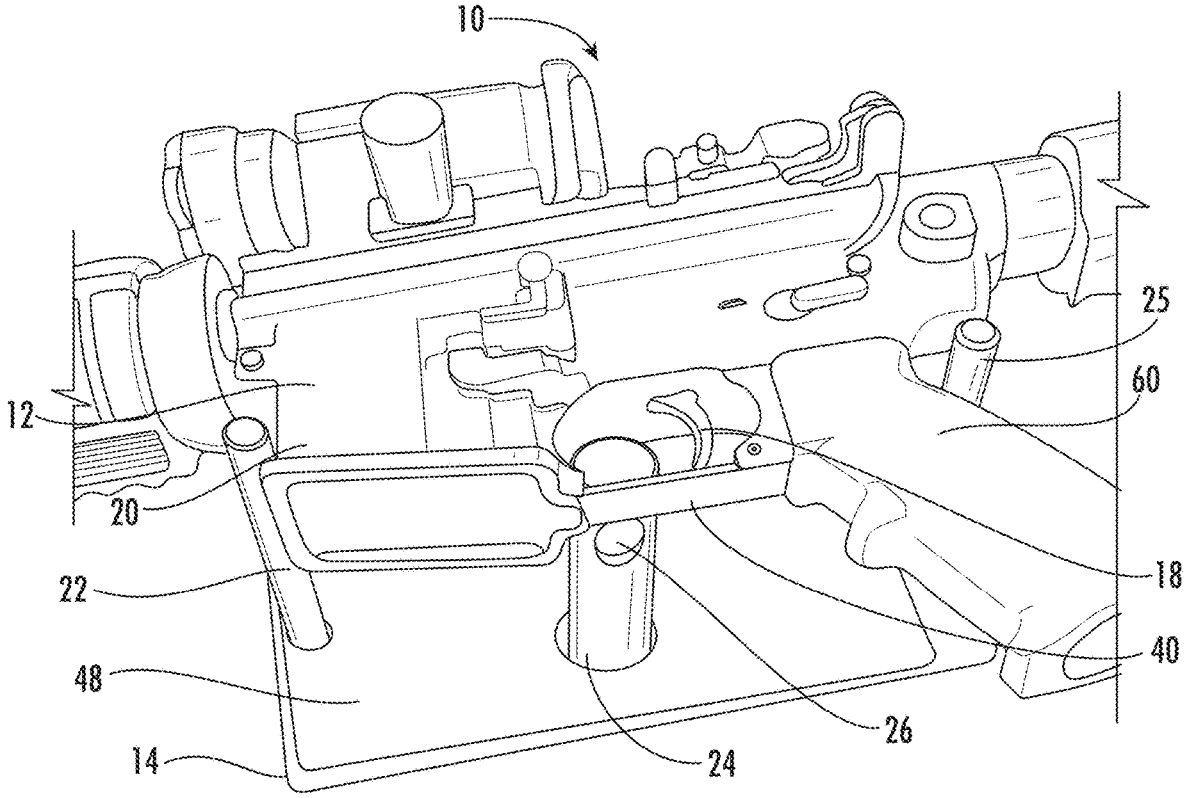
FIG. 8 is a perspective view of a firearm being positioned into the portable firearm securement system.
Figure 9:
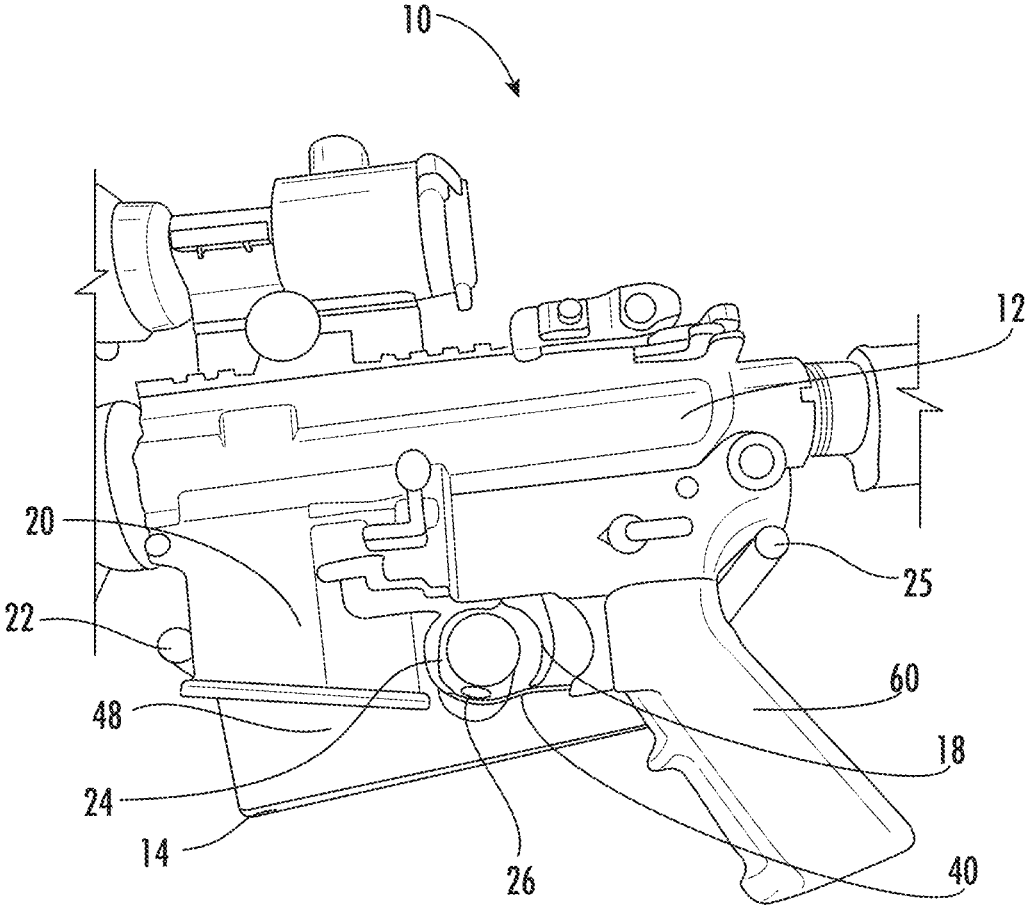
FIG. 9 is a perspective view of a firearm being positioned into the portable firearm securement system by aligning the first pin with the downrange side of the magazine and the second pin within the trigger guard.
Figure 10:
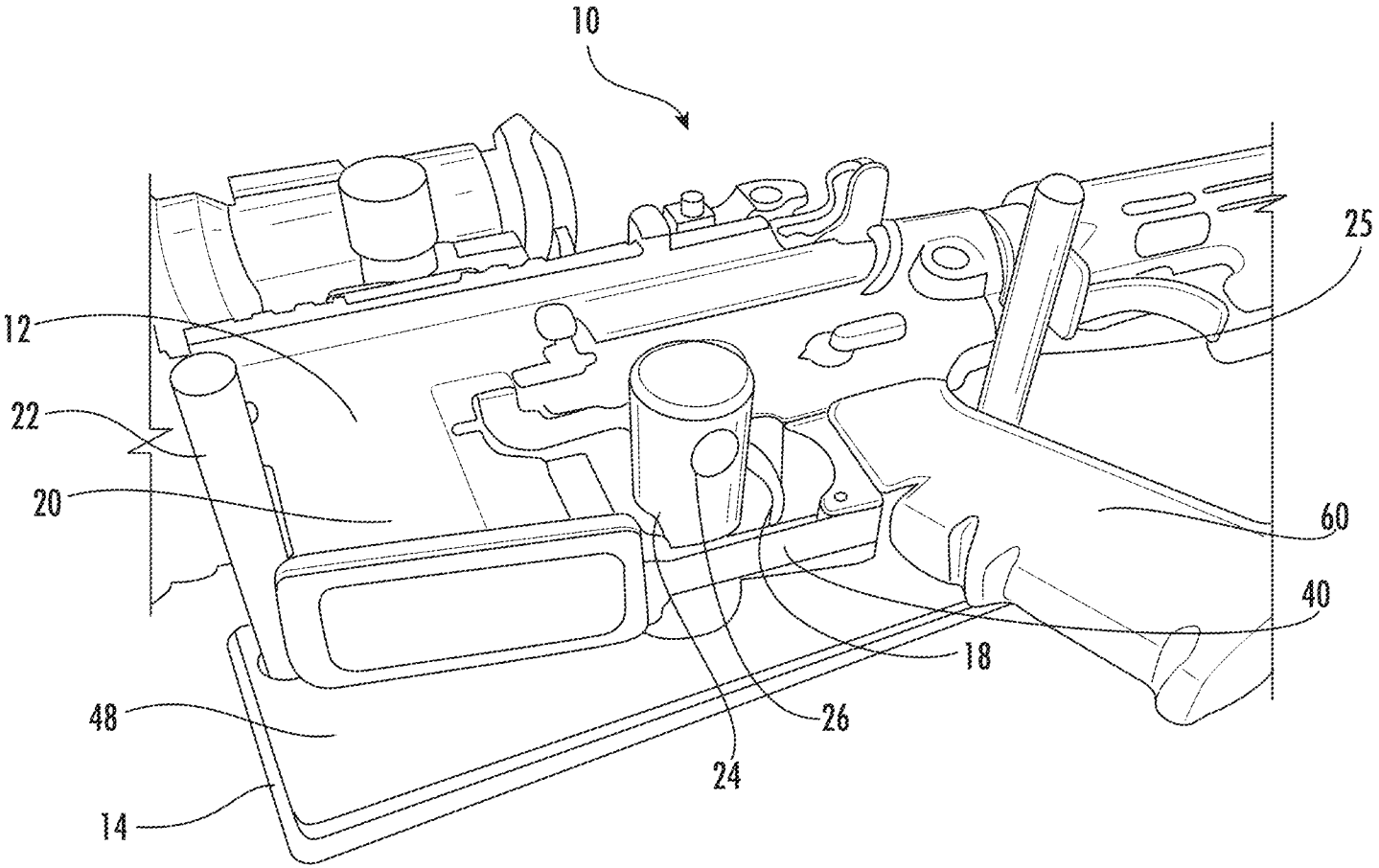
FIG. 10 is a perspective view of a firearm being positioned into the portable firearm securement system with the firearm contacting the first pad on the first body.
Figure 11:
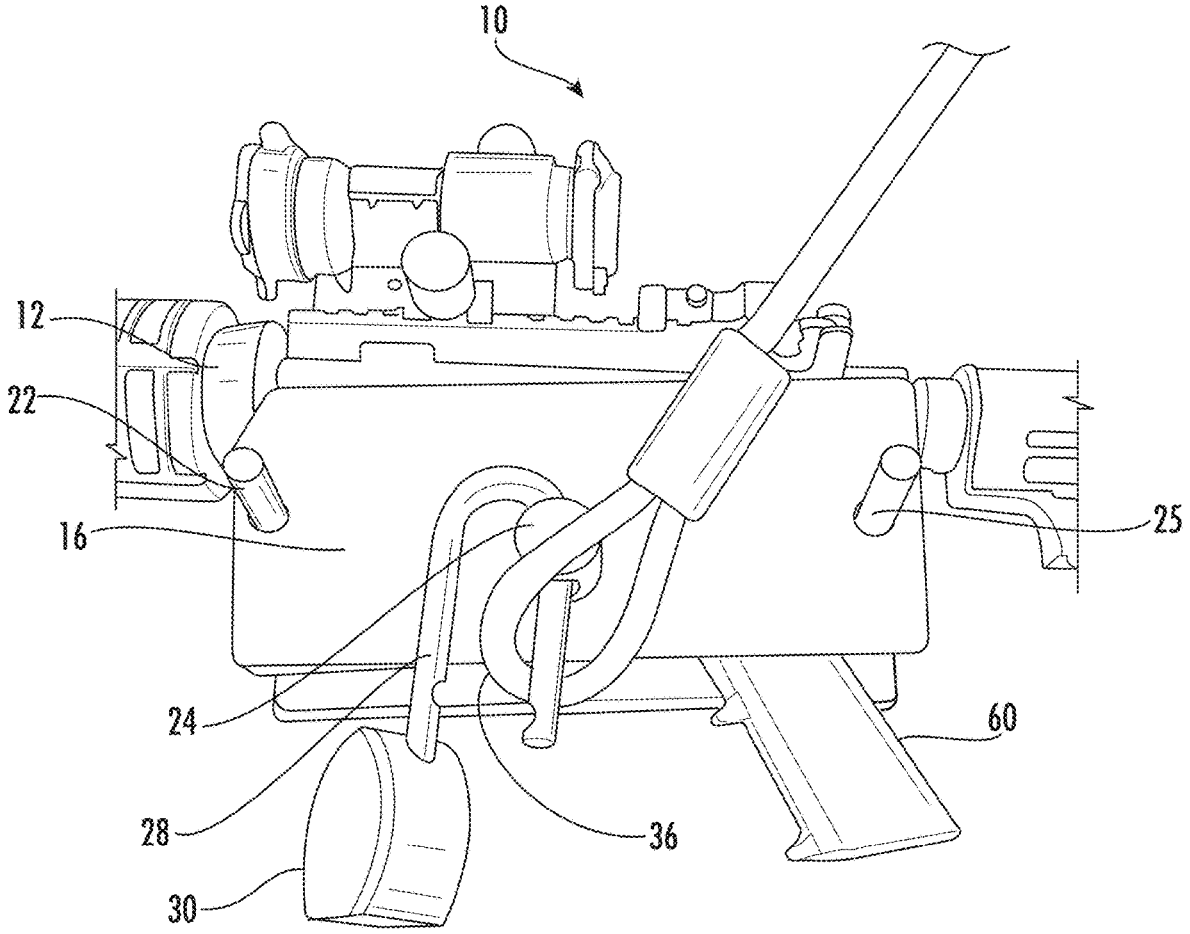
FIG. 11 is a perspective view of a firearm positioned in the portable firearm securement system with the second body in place and a shackle of a padlock inserted into a securement orifice in the second pin with a cable attached to the shackle.
Figure 12:
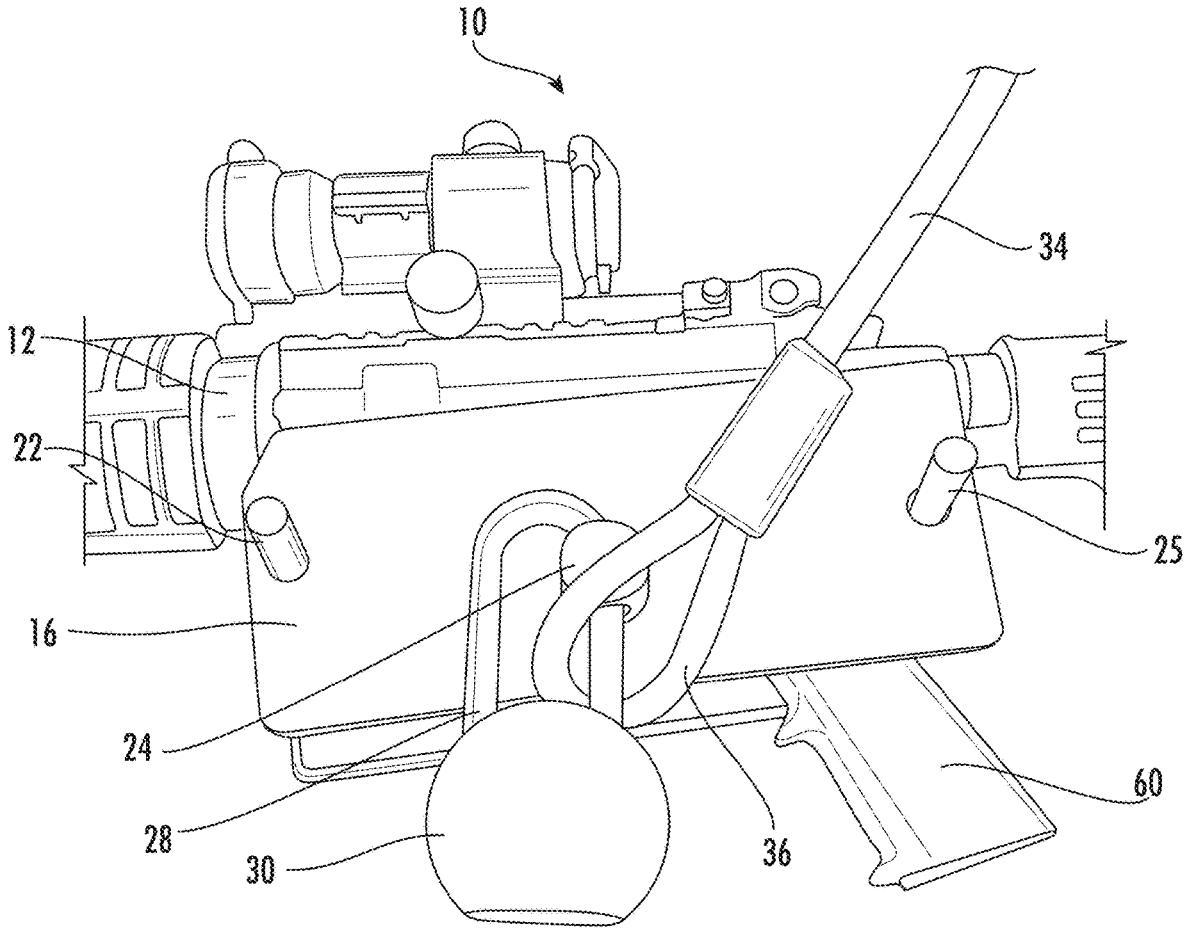
FIG. 12 is a perspective view of the firearm and portable firearm securement system of FIG. 11 with the padlock in a locked position.
Figure 13:
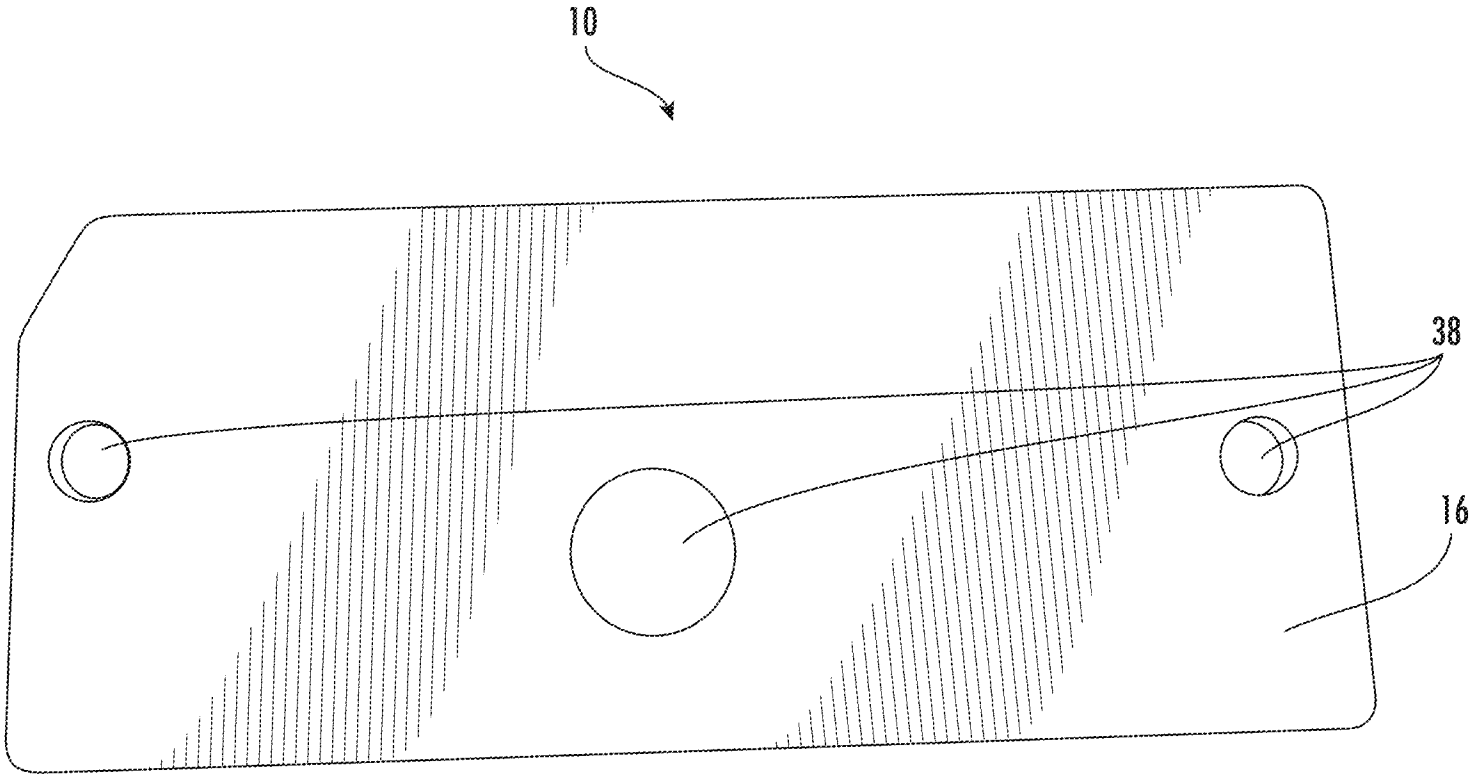
FIG. 13 is a perspective view of the second body.
Figure 14:
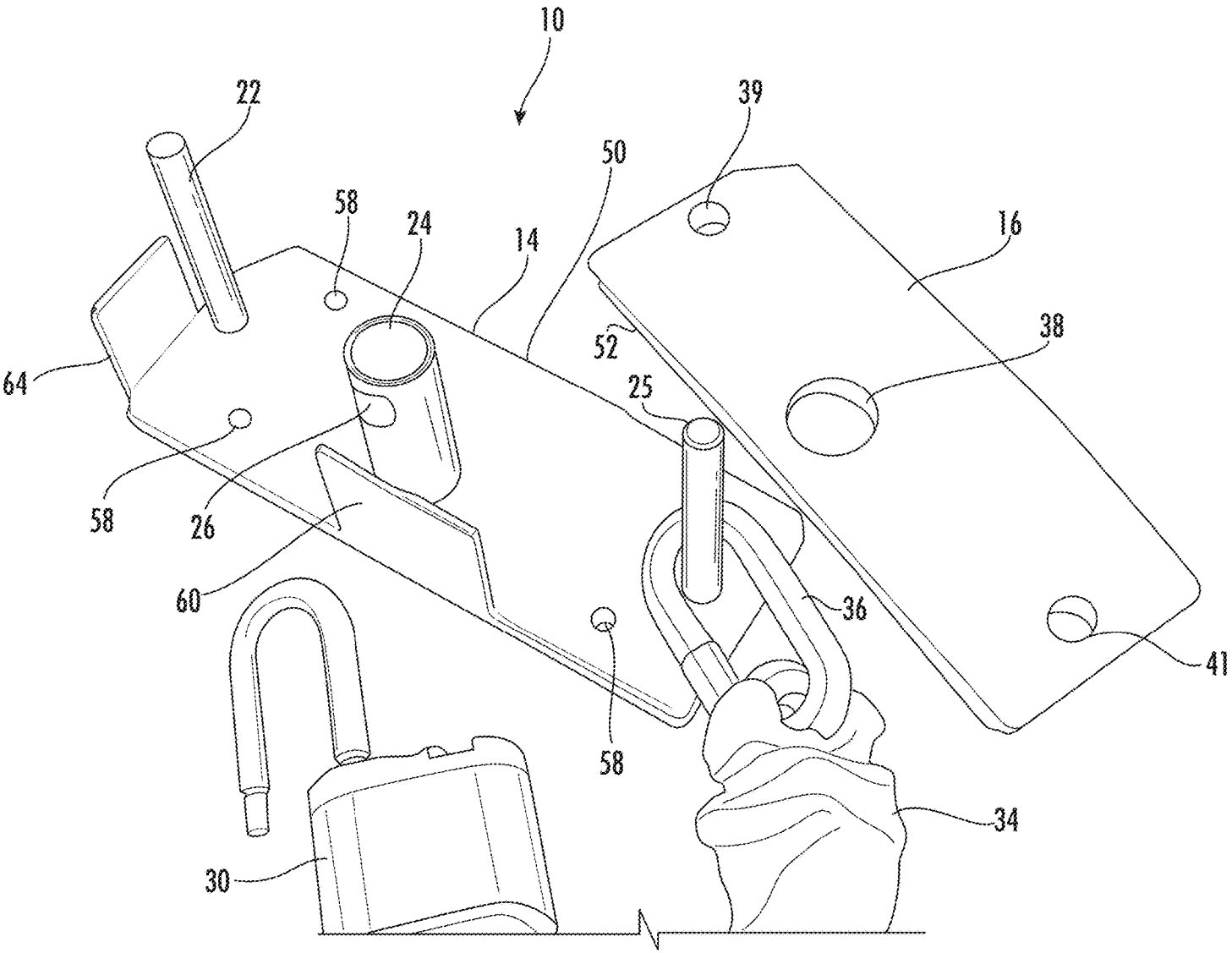
FIG. 14 is a top, exploded, perspective view of another embodiment of the first body shown with the second body, lock and tether.
Figure 15:
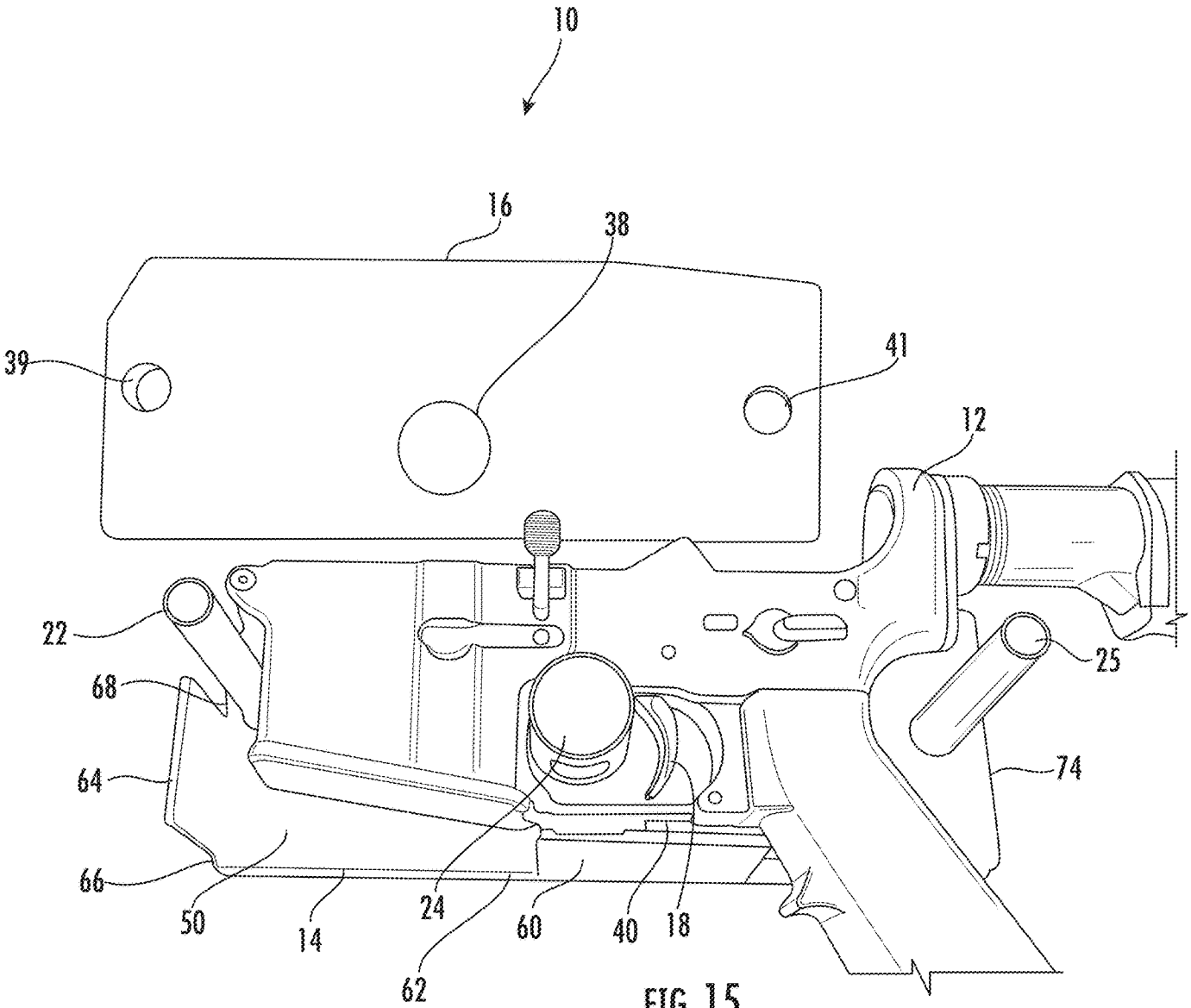
FIG. 15 is a top, exploded, perspective view of the embodiment shown in FIG. 14 with a breach portion of a firearm positioned on the first body and the second body placed on a surface supporting the first body.
Figure 16:
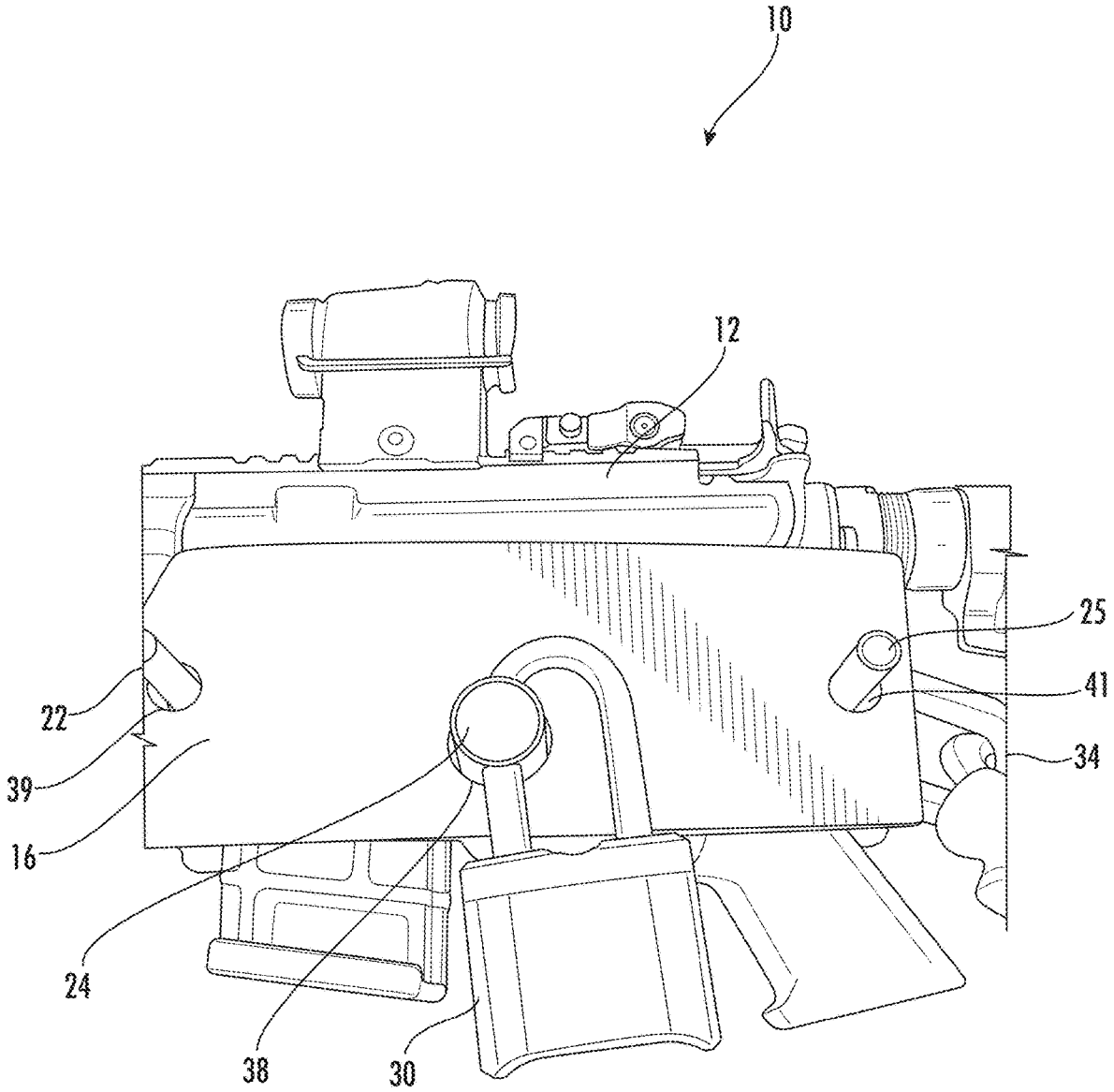
FIG. 16 is a top perspective view of the second body resting in place on a firearm secured between the first and second bodies with a lock extending thru an orifice in the second pin.
Figure 17:
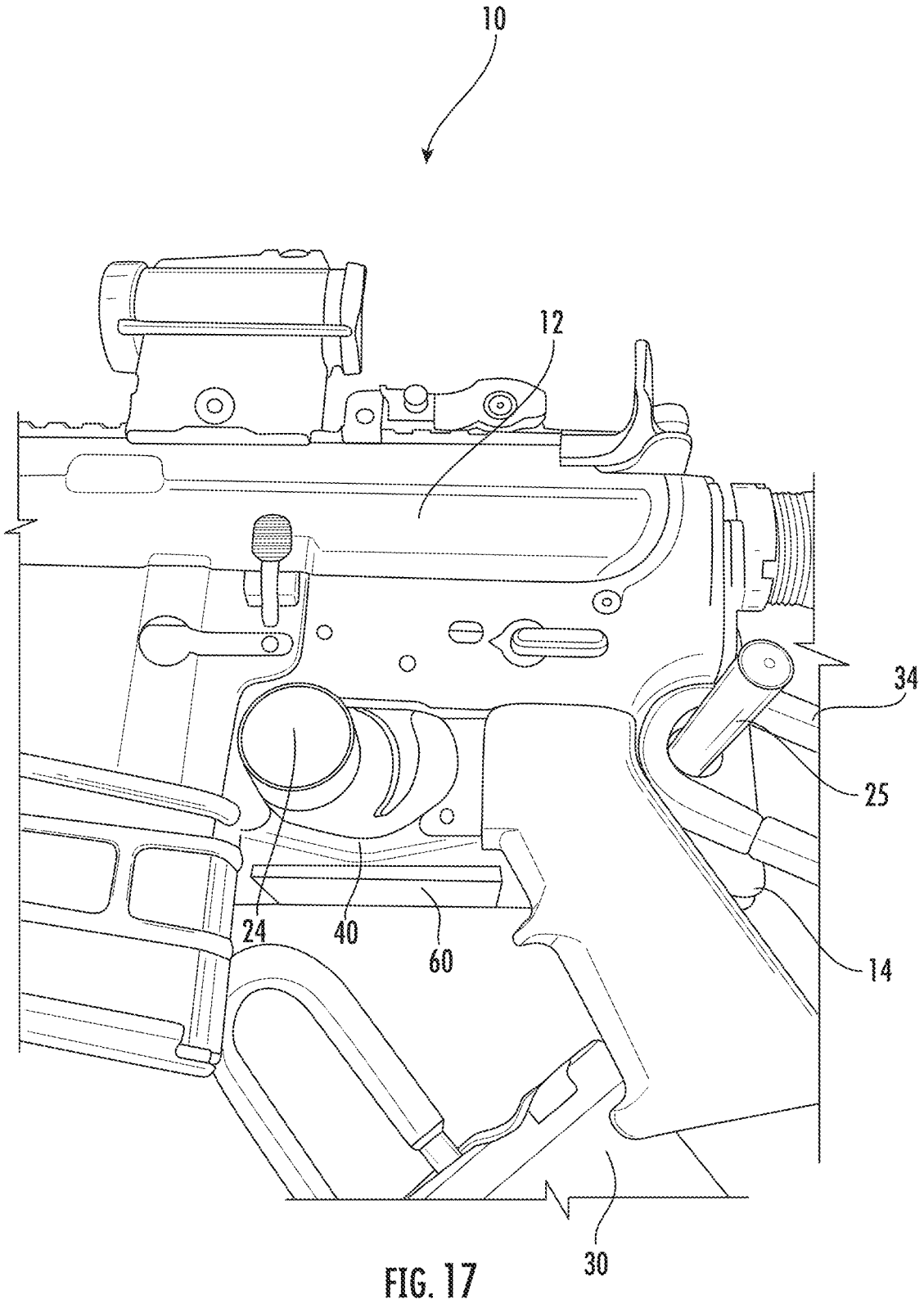
FIG. 17 is a top, exploded perspective view of a firearm resting on the first body and the second pin positioned within the space created by the trigger guard, together with the bottom shield position proximate to the trigger guard to prevent unwanted access to the trigger.
Figure 18:
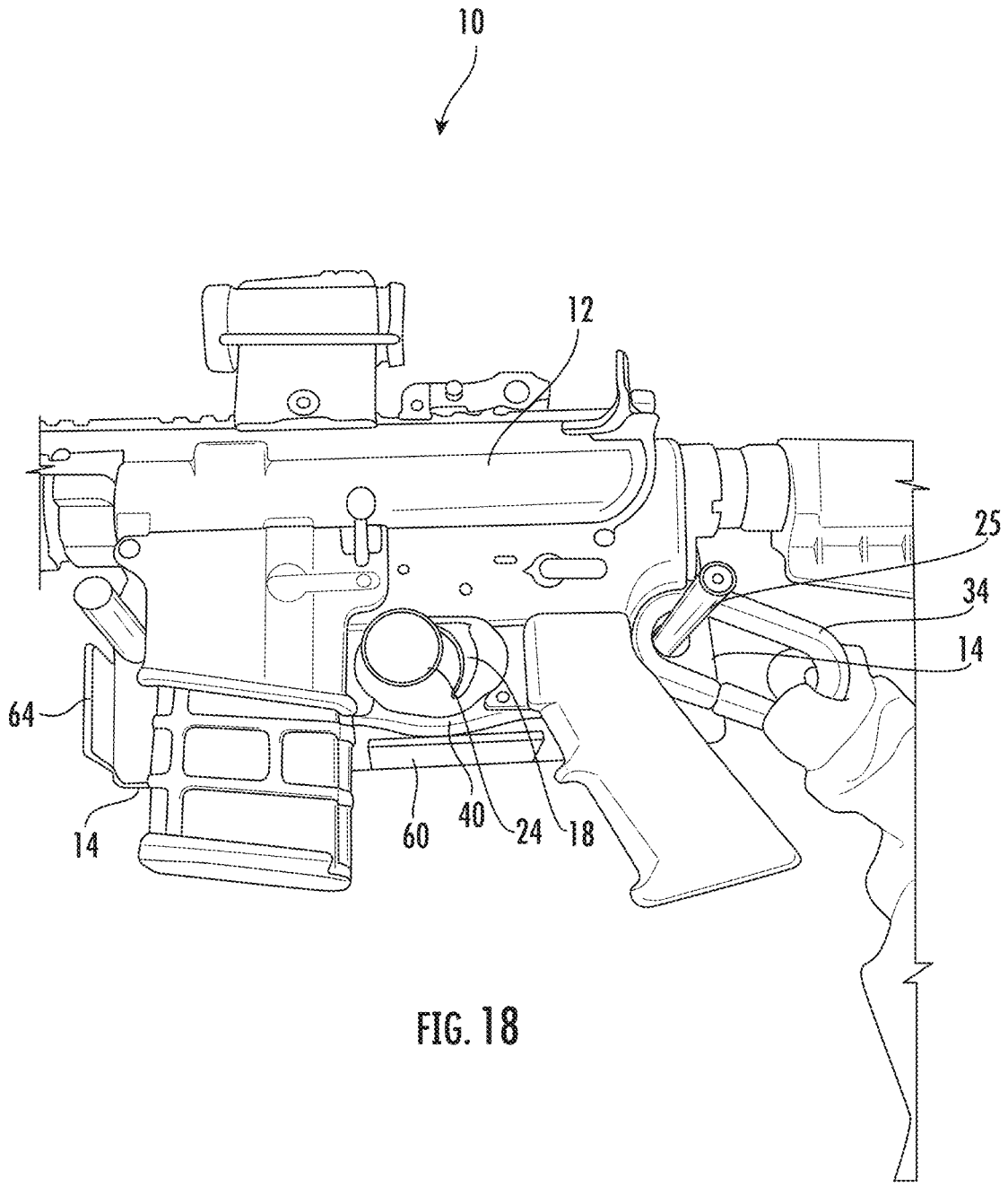
FIG. 18 is another top, exploded perspective view of a firearm resting on the first body and the second pin positioned within the space created by the trigger guard, together with the bottom shield position proximate to the trigger guard to prevent unwanted access to the trigger.
Figure 19:
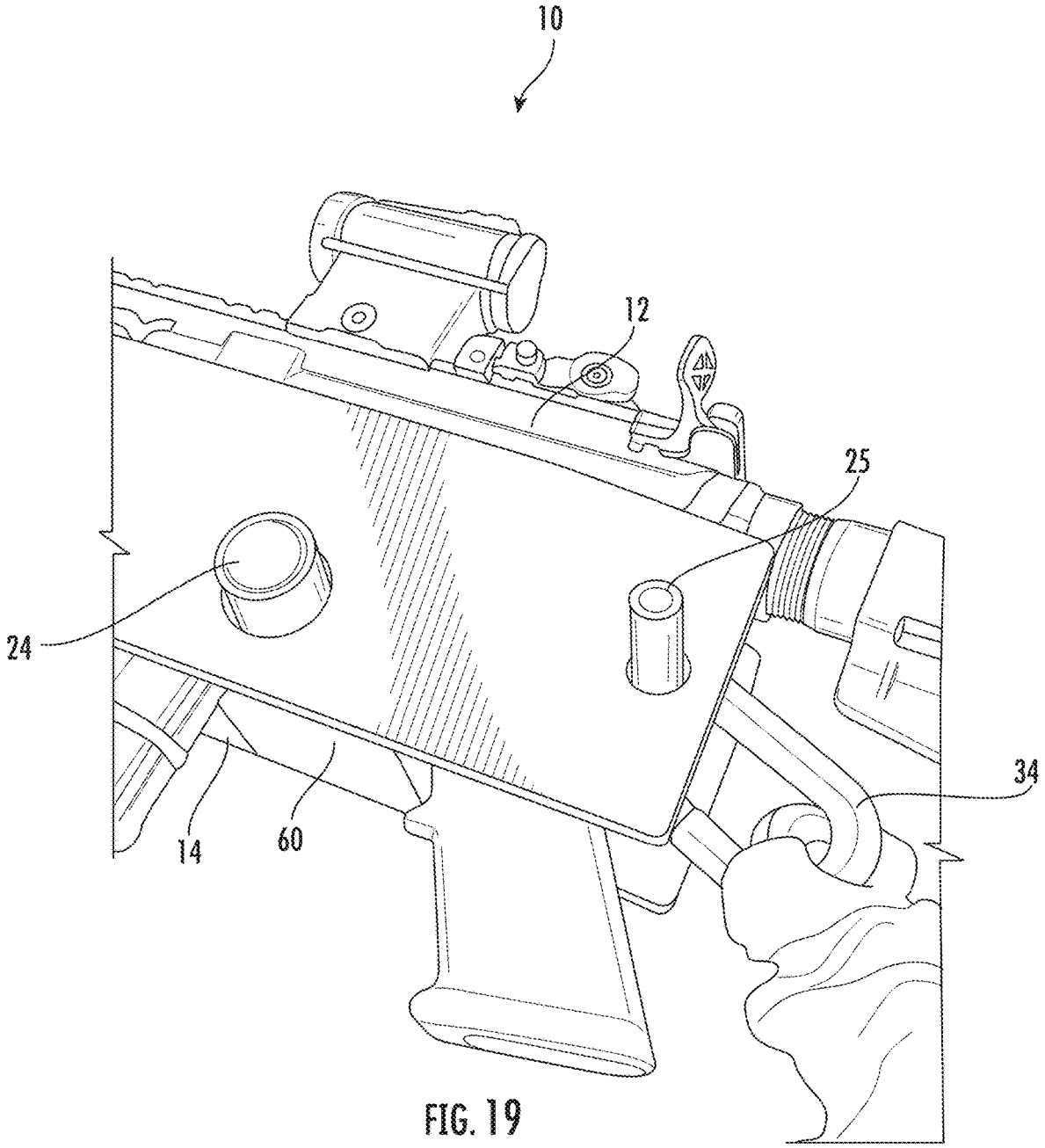
FIG. 19 is a top perspective view of the second body positioned on a firearm resting on the first body and the tether attached to the third pin positioned proximate to the rear side (also referred to as the second side).
Figure 20:
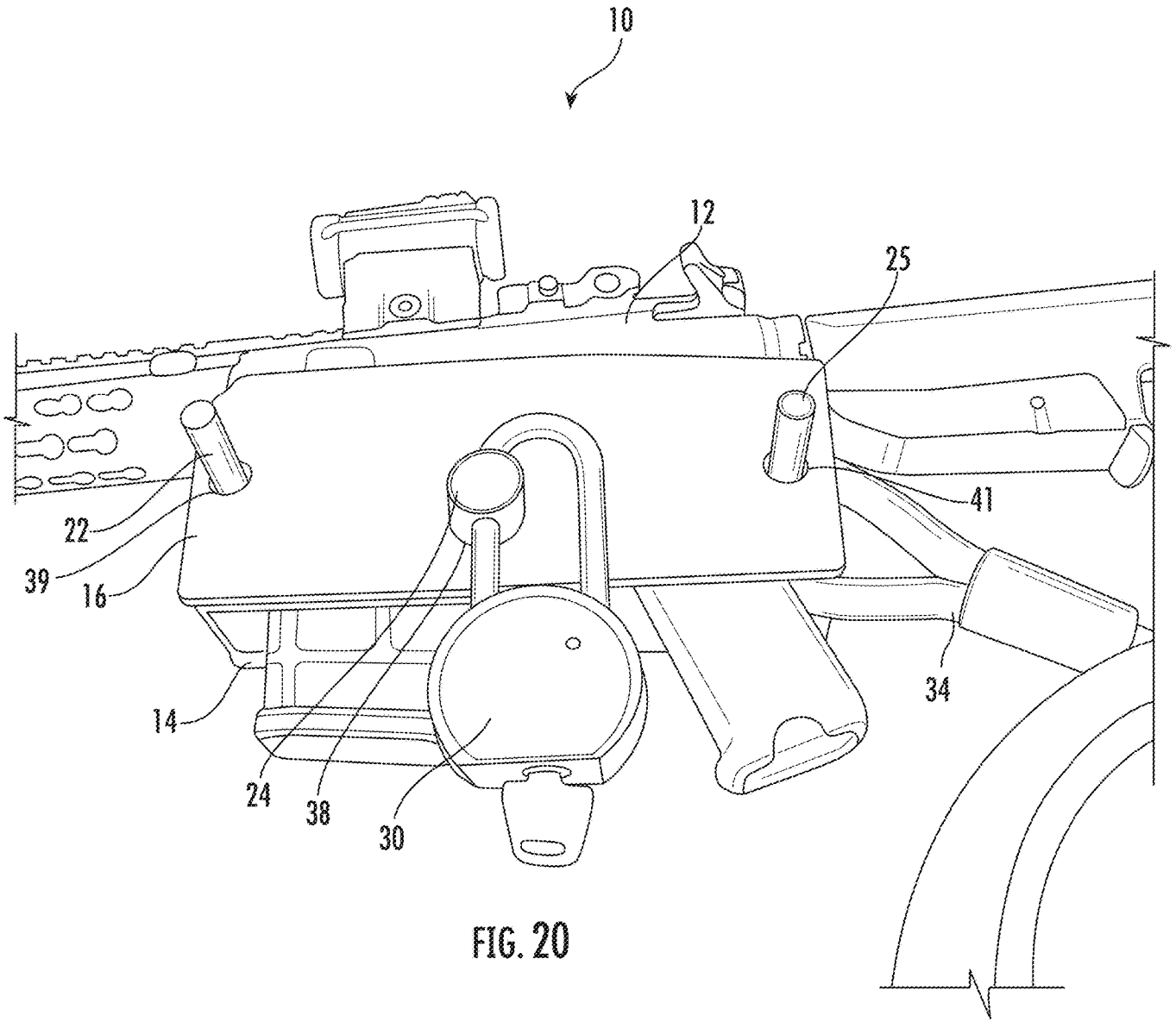
FIG. 20 is top perspective view of the second body positioned on a firearm resting on the first body, the tether attached to the third pin positioned proximate to the rear side (also referred to as the second side) and a lock extending thru an orifice in the second pin to secure the firearm within the system.
Figure 21:
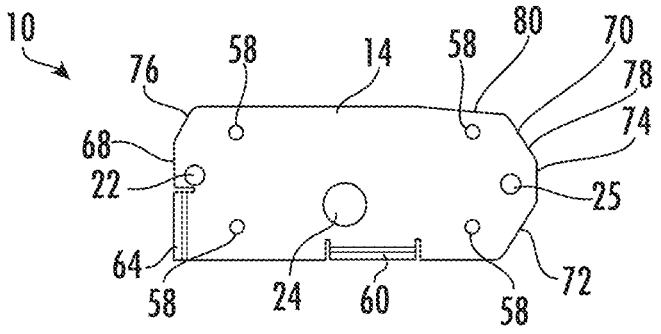
FIG. 21 is a top view of the first body with the bottom shield and side shield extending out of the paper.
Figure 22:
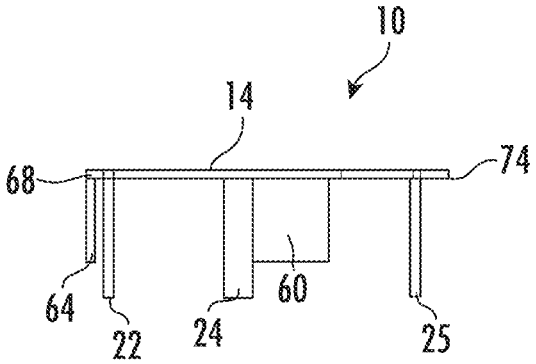
FIG. 22 is a back side view of the first body of FIG. 21.
Figure 23:
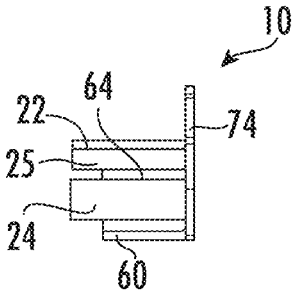
FIG. 23 is a right side view of the first body of FIG. 21.
Figure 24:
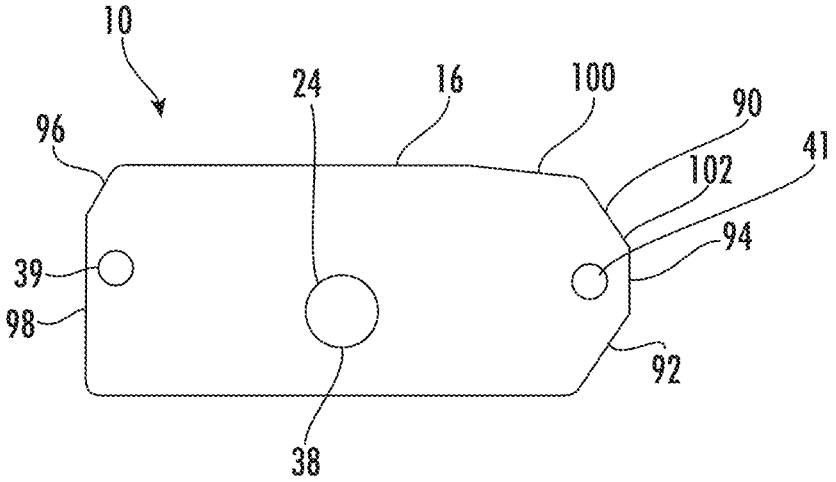
FIG. 24 is a top view of the second body.
Figure 25:
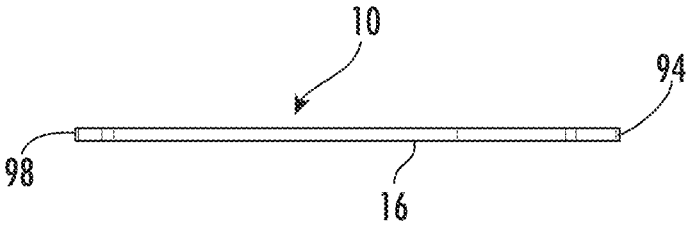
FIG. 25 is a back side view of the second body of FIG. 24.
Figure 26:
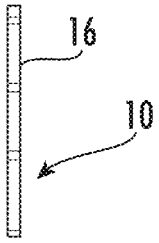
FIG. 26 is a right side view of the second body of FIG. 24.

During use, the portable firearm securement system 10 may be placed into a vehicle or other location in which a user wants to secure a firearm 12. The first body 14 may be placed on a rear seat of a vehicle. A firearm 12 may be positioned on the first body 14, as shown in FIGS. 8-10, by first moving a downrange facing surface of the magazine well 20 in contact with the first pin 22 while also aligned the second pin 24 to slide into the space created between the trigger guard 40 and the body of the firearm 12. The firearm 12 may then be rested on the first pad 48 on the first body 14. The second body 16 may be positioned so that the second pin 24 is inserted into the orifice 38 in the second body 16. In the embodiment shown in FIGS. 14-26, the first and third pins 22, 25 may be guided into orifices 39 and 41. The second body 16 is then moved into contact with the firearm 12. The second body 16 is then pressed towards the first body 14 so that the first and second pads 48, 52 are at least partially compressed and the securement orifice 26 is fully exposed enabling a shackle 28 of a padlock to be inserted into the securement orifice 26. The shackle 28 prevents the second body 16 from becoming detached from the system 10 and enabling the firearm 12 from being removed. A cable 34 may be wrapped around a securement object 32, which may be, but is not limited to being, a seat structure. Both ends of the cable 34 with loops 36 may be attached to the shackle 28 and the padlock 30 locked. Alternatively, one end of the cable 34 may form a slip knot around a securement object 32, which may be, but is not limited to being, a seat structure, and the other end of the cable 34 may be attached to the shackle 28. In another embodiment, shown in FIGS. 14-26, a loop 36 of the tether 34 may be placed over a pin 22, 24, 25 before the second body is placed into position. The other end of the tether 34 may have already been attached to a securement object 32 via a slip knot or other method.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A portable firearm securement system, comprising:

a first body for securing a firearm and preventing access to a trigger of the firearm;

a second body securing the firearm and preventing access to a trigger of the firearm without contacting an optic sight of the firearm;

a first pin secured to the first body and extending toward the second body;

a second pin secured to the first body and extending thru an orifice in the second body;

a third pin secured to the first body and extending toward the second body;

a securement orifice in the second pin proximate to a distal end of the second pin for securing the second body in place on the second pin;

wherein the first and second bodies form a firearm securement cavity between the first and second bodies;

wherein the first pin is configured to be placed downrange of a downrange facing surface of a magazine well of the firearm;

wherein the second pin is configured to be placed aft of the magazine well and inside of the trigger guard;

wherein the third pin is configured to be placed in close proximity to an aft surface of a handle of the firearm; and wherein the first pin, second pin and third pin alone prevent the firearm from being removed from the portable firearm securement system when the firearm is positioned between the first body and second body and a padlock extends through the securement orifice.

2. The portable firearm securement system of claim 1, wherein the first body is formed from a plate.

3. The portable firearm securement system of claim 1, wherein the second body is formed from a plate.

4. The portable firearm securement system of claim 1, further comprising a padlock with a shackle sized to fit within the securement orifice in the second pin to prevent the second body from being removed from the second pin.

5. The portable firearm securement system of claim 4, further comprising a tether with loops at each end for securing the portable firearm securement system to a securable object by looping one end of the tether around at least a portion of the securable object and attaching at least one end of the tether to the shackle of the padlock.

6. The portable firearm securement system of claim 4, further comprising a tether with loops at each end for securing the portable firearm securement system to a securable object by looping one end of the tether around at least a portion of the securable object and attaching at least one end of the tether to the third pin.

7. The portable firearm securement system of claim 1, wherein a distance between the first pin and second pin as greater than a length of a magazine well on a firearm but less than a distance of the length of a magazine well on the firearm plus a distance between the magazine well and a trigger of the firearm minus a diameter of the pin.

8. The portable firearm securement system of claim 7, wherein a distance between the first pin and second pin is greater than a length of a magazine well on a firearm plus no more than 0.25".

9. The portable firearm securement system of claim 8, wherein a distance between the first pin and second pin is greater than a length of a magazine well on a firearm plus no more than 0.05".

10. The portable firearm securement system of claim 1, further comprising a first pad attached to an inner side of the first body for protecting a firearm secured within the system and to create a retention force exerted by the first body on the firearm.

11. The portable firearm securement system of claim 1, further comprising a second pad attached to an inner side of the second body for protecting a firearm secured within the system and to create a retention force exerted by the second body on the firearm.

12. The portable firearm securement system of claim 1, further comprising a plurality of mounting holes in the first body for attaching the first body to a structure.

13. The portable firearm securement system of claim 1, further comprising a bottom shield extending from the first body generally toward the second body and positioned between the second pin and an edge of the first body.

14. The portable firearm securement system of claim 1, further comprising a side shield extending from the first body generally toward the second body and positioned between the first pin and an edge of the first body.

15. The portable firearm securement system of claim 1, wherein the first body has a side shield at a first side and first and second angled corners at a second side.

16. A portable firearm securement system, comprising:

a first body for securing a firearm and preventing access to a trigger of the firearm;

a second body securing a firearm and preventing access to a trigger of the firearm without contacting an optic sight of the firearm;

a first pin secured to the first body and extending toward the second body;

a second pin secured to the first body and extending thru an orifice in the second body;

a third pin secured to the first body and extending toward the second body;

a securement orifice in the second pin proximate to a distal end of the second pin for securing the second body in place on the second pin;

wherein the first and second bodies form a firearm securement cavity between the first and second bodies;

wherein the first pin is configured to be placed downrange of a downrange facing surface of a magazine well of the firearm;

wherein the second pin is configured to be placed aft of the magazine well and inside of the trigger guard;

wherein the third pin is configured to be placed in close proximity to an aft surface of a handle of the firearm;

a bottom shield extending from the first body generally toward the second body and positioned between the second pin and a bottom edge of the first body;

a side shield extending from the first body generally toward the second body and positioned between the first pin and a side edge of the first body; and wherein the first pin, second pin and third pin alone prevent the firearm from being removed from the portable firearm securement system when the firearm is positioned between the first body and second body and a padlock extends through the securement orifice.

17. The portable firearm securement system of claim 16, further comprising a padlock with a shackle sized to fit within the securement orifice in the second pin to prevent the second body from being removed from the second pin and a tether with loops at each end for securing the portable firearm securement system to a securable object by looping one end of the tether around at least a portion of the securable object and attaching at least one end of the cable to the third pin.

18. The portable firearm securement system of claim 16, wherein a distance between the first pin and second pin as greater than a length of a magazine well on a firearm but less than a distance of the length of a magazine well on the firearm plus a distance between the magazine well and a trigger of the firearm minus a diameter of the pin.

19. The portable firearm securement system of claim 18, wherein a distance between the first pin and second pin is greater than a length of a magazine well on a firearm plus no more than 0.25", and wherein a distance between the first pin and second pin is greater than a length of a magazine well on a firearm plus no more than 0.05".

20. The portable firearm securement system of claim 16, further comprising a first pad attached to an inner side of the first body for protecting a firearm secured within the system and to create a retention force exerted by the first body on the firearm and a second pad attached to an inner side of the second body for protecting a firearm secured within the system and to create a retention force exerted by the second body on the firearm.

* * * * *